US005804789A

United States Patent [19]

Saito et al.

[11] Patent Number: 5,804,789

[45] Date of Patent: Sep. 8, 1998

[54] SURFACE TREATING METHOD AND APPARATUS BY ELECTRIC DISCHARGE MACHINING

[75] Inventors: Nagao Saito, 12-12, Iwanaridai 9-chome, Kasugai-shi, Aichi 487, Japan; Naotake Mouri, Nagoya, Japan; Hidetaka Miyake, Tokyo, Japan; Yoshihito Imai, Tokyo, Japan; Takuji Magara, Tokyo, Japan; Akihiro Goto, Tokyo, Japan

[73] Assignees: Japan Science and Technology Corporation, Saitama; Mitsubishi Denki Kabushiki Kaisha, Tokyo; Nagao Saito; Naotoke Mouri, both of Aichi, all of Japan

[21] Appl. No.: 796,138

[22] Filed: Feb. 6, 1997

[30] Foreign Application Priority Data

Jun. 12, 1996 [JP] Japan ..... 8-151357

[51] Int. Cl.[6] ..... B23H 1/00; B23H 9/00

[52] U.S. Cl. ..... 219/69.17; 219/69.2

[58] Field of Search ..... 219/69.14, 69.17, 219/69.16, 69.2; 427/580

[56] References Cited

U.S. PATENT DOCUMENTS

| | | | |
|---|---|---|---|
| 5,434,380 | 7/1995 | Magara et al. | 219/69.14 |
| 5,539,172 | 7/1996 | Takase et al. | 219/69.17 |
| 5,648,122 | 7/1997 | Rao et al. | 219/69.17 |
| 5,651,901 | 7/1997 | Mohri et al. | 219/69.17 |

FOREIGN PATENT DOCUMENTS

| | | | |
|---|---|---|---|
| 5-93283 | 4/1993 | Japan | 427/580 |
| 5-148615 | 6/1993 | Japan . | |
| 7-112329 | 5/1995 | Japan . | |
| 7-49170 | 5/1995 | Japan . | |

*Primary Examiner*—Geoffrey S. Evans
*Attorney, Agent, or Firm*—Sughrue, Mion, Zinn, Macpeak & Seas, PLLC

[57] ABSTRACT

A surface treating apparatus rotates a rotating tool and moves a surface treating electrode relative to the tool via a rotating shaft driver and a Z-axis driver. A power source applies voltage to generate an electric discharge between the tool and the electrode, thereby forming a reforming layer on a peripheral flank and a rake face of the tool.

14 Claims, 20 Drawing Sheets

SURFACE TREATING METHOD AND APPARATUS BY ELECTRIC DISCHARGE MACHINING

BACKGROUND OF THE INVENTION

1. Field of the Invention

This invention relates to a surface treating method and apparatus utilizing an electric discharge machining that is applied to a surface treating of a cutting edge portion of a cutting tool such as a rotating tool. Particularly, it relates to a surface treating method and apparatus for forming a reforming layer on a cutting tool.

2. Description of the Related Art

A Japanese Patent Publication (Kokai) 7-112329 discloses a method and an apparatus that forms a reforming layer on a tooth or a cutting edge portion of a rotating tool by use of an electric discharge machining. This publication shows a technique described below.

FIG. 25 illustrates an entire structure of a surface treating apparatus of the related art.

Referring to FIG. 25, the surface treating is performed on a rotating cutting tool 101 such as an end mill, a twist drill or the like. A green compact block 102 is formed by pressing powders of a reforming material. The reforming material is made by sintering powders of tungsten carbide (WC) mixed with cobalt (Co) powders. A main shaft 103 moves the rotating cutting tool 101 vertically or in a Z-axis direction. The green compact block 102 is fixed on a processing vessel 104 which is filled with a working fluid 105 for an electric discharge machining. An electric discharge power source 106 applies voltage between the rotating cutting tool 101 and the green compact block 102. An interpole detecting device detects an interpole voltage or a short circuit between the rotating cutting tool 101 and the green compact block 102. A control unit 108 controls a relative moving speed of the cutting tool 101 and the green compact block 102 by a detection result of the interpole detecting device 107. A Z-axis driving device 109 drives the main shaft 103 vertically or in the Z-axis direction together with the cutting tool 101. An X-axis driving device 110 drives the processing vessel 104 in an X-axis direction together with the green compact block 102. A Y-axis driving device 111 drives the processing vessel 104 in a Y-axis direction together with the green compact block 102. A rotating drive device 112 is associated with the Z-axis driving device 109 and rotates the cutting tool 101.

An operation of such a surface treating apparatus in the related art is described hereafter.

The cutting tool 101 is held on the main shaft 103 and rotated by the rotating drive device 112. Then, the cutting tool 101 and the green compact block 102 are relatively moved by the X-axis driving device 110, Y-axis driving device 111 and Z-axis driving device 109, so that the cutting tool 101 cuts the green compact block 102. More in detail, in case the cutting tool 101 is an end mill, it cuts the block 102 mainly in a width direction (X-axis direction and Y-axis direction). If the cutting tool 101 is a twist drill, it cuts the block 102 in an axial direction (Z-axis direction). At this time, the power source 106 applies voltage for electric discharge between the cutting tool 101 and the green compact block 102. Accordingly, when the cutting processing advances and the cutting tool 101 and the green compact block 102 stop contacting with each other, an electric discharge is generated at a gap therebetween. The reforming material (WC) is floating in the form of powders at the gap due to the cutting processing. Therefore, the WC powders are mixed into a surface around a cutting edge of the cutting tool 101. A feeding speed of the cutting tool 101 is controlled appropriately so that the cutting and the electric discharge are performed in turn. Thus, the surface treating processing is continuously carried out, and the reforming layer of WC alloy is formed uniformly on the cutting edge portion, as mentioned above.

Namely, the above publication discloses a method which performs an electric discharge, while cutting the block containing a coating material, by the cutting tool. In this method, the reforming layer is formed on the cutting edge portion of the cutting tool by generating an electric discharge between the block and the cutting edge portion.

This method combines two contradictory machining processes: the cutting process, in which the block and the the cutting edge of the tool are contacted with each other, and the electric discharge process, in which the block and the cutting edge of the tool are not contacted. However, the electric discharge machining is carried out when there is formed a gap suitable for generating the electric discharge, by the cutting, between the cutting edge of the tool and the block. Namely, the electric discharge machining is performed by chance depending on the cutting and cannot be controlled. Therefore, it is difficult to have a stable processing and form a uniform reforming layer on the cutting edge portion of the tool.

Moreover, the cutting edge of the tool is abraded by friction against the block in the cutting process, so that the cutting edge gets dull by a concentrated electric discharge in the electric discharge process. Then, it is necessary to grind the cutting edge portion on which the reforming layer is built. Furthermore, the surface treating apparatus needs a mechanical rigidity more than a normal electric discharge machine, due to a cutting resistance generated when the rotating tool cuts the block which contains the reforming material.

SUMMARY OF THE INVENTION

It is an object of the invention to provide a surface treating method and apparatus that can form a reforming layer uniformly on a cutting edge portion of a tool to highly improve a tool life only by an electric discharge machining, while improving sharpness of the cutting edge.

According to one preferred mode of the invention, there is provided a surface treating method by electric discharge machining that forms a reforming layer on a tooth of a rotating tool by a surface treating electrode made of a reforming material. The surface treating electrode is placed opposite to the tooth. The surface treating electrode is relatively moved along the tooth, while an electric discharge is generated between the tooth and the surface treating electrode. Thereby, the reforming layer is formed on the tooth.

According to one preferred mode of the invention, there is provided a surface treating apparatus by electric discharge machining. The apparatus comprises a rotating tool having a tooth. A surface treating electrode made of a reforming material forms a reforming layer on the tooth. A relative movement driver rotates the rotating tool and relatively moves the surface treating electrode along the tooth while placing the surface treating electrode opposite to the tooth. An electric discharge power source applies voltage between the tooth and the surface treating electrode.

Further objects and advantages of the invention will be apparent from the following description, reference being had to the accompanying drawings, wherein preferred embodiments of the invention are clearly shown.

DETAILED DESCRIPTION OF THE PREFERRED EMBODIMENTS

Figure 1:
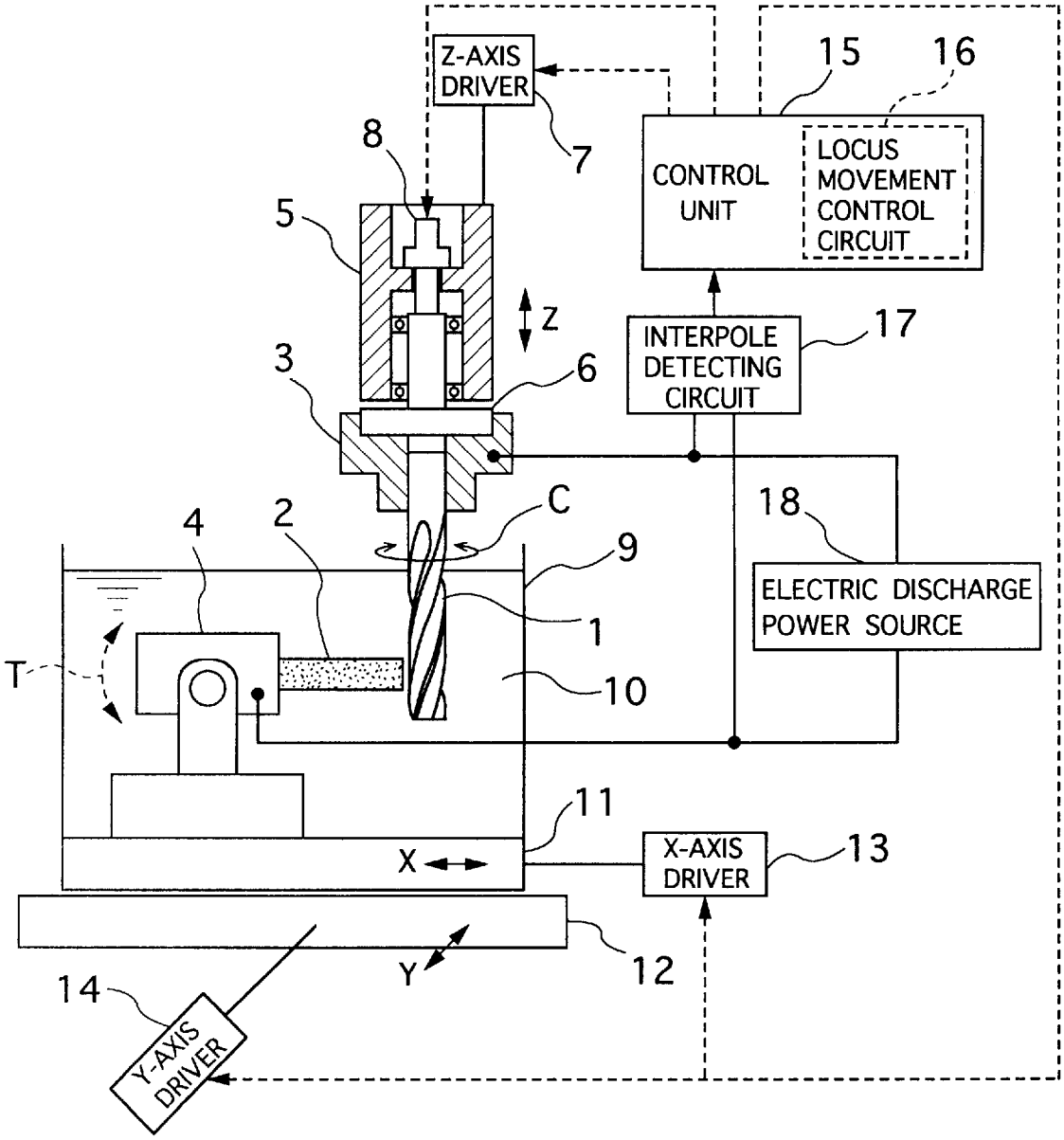
FIG. 1 is a schematic view showing an entire structure of a surface treating apparatus by electric discharge machining according to a first embodiment of the invention.

Several preferred embodiments of a surface treating method and apparatus of the invention will be described hereafter referring to the drawings. In the drawings, the same reference characters and numerals indicate the same or corresponding elements which are commonly used in the embodiments, and their description is omitted to avoid redundancy.

First Embodiment

Figure 2:
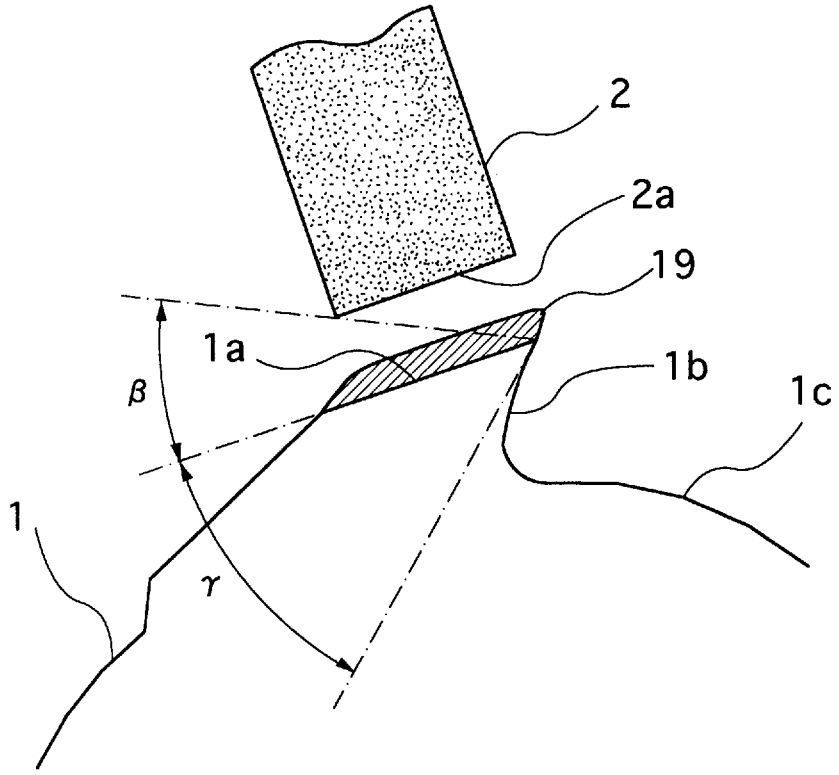
FIG. 2 is an explanatory view showing a main portion, i.e. a cutting edge portion of a rotating tool which is processed by the surface treating apparatus of the first embodiment.

FIG. 1 illustrates an entire structure of a surface treating apparatus by electric discharge machining according to a first embodiment of the invention. FIG. 2 illustrates a main portion or a cutting edge portion of a rotating tool which is processed by the surface treating apparatus of the first embodiment.

In FIGS. 1 and 2, the surface treating is performed on a rotating tool 1 such as an end mill, a twist drill or the like. A surface treating electrode 2 is made of a component which constitutes a reforming layer, e.g. TiC, TiH2 or the like. The electrode 2 may be formed by sintering the powders of the reforming material (WC or the like) in the related art. The rotating tool 1 is held by a chuck 3. The surface treating electrode 2 is held coaxially on an electrode holder 4. A main shaft 5 moves the rotating tool 1 in a Z-axis direction. A rotating shaft 6 rotates the rotating tool 1 in a circumferential direction C about its center axis (called C axis hereafter). A Z-axis driver 7 drives the main shaft 5 vertically or in the Z-axis direction together with the rotating tool 1. A rotating shaft driver 8 composed of a motor or the like drives the rotating shaft 6. The electrode holder 4 is fixed inside a processing vessel 9 which contains a working fluid 10 for an electric discharge machining. The processing vessel 9 can be moved horizontally in the X-axis direction through an X-table 11 and in the Y-axis direction through a Y-table 12. An X-axis driver 13 drives the X-table 11 in the X-axis direction. A Y-axis driver 14 drives the Y-table 12 in the Y-axis direction. A control unit 15 is composed of a computer or the like. A locus movement control circuit 16 is provided in the control unit 15. The locus movement control circuit 16 controls a movement of the rotating tool 1 so that a discharge surface of the surface treating electrode 2 traces a peripheral flank or a cutting edge portion of the tool 1. The locus movement control circuit 16 corresponds to a normal numerical control circuit. An interpole detecting circuit 17 detects an interpole voltage (voltage between electrodes) or a short circuit between the rotating tool 1 (one electrode) and the surface treating electrode 2 (counter electrode). An electric discharge power source 18 applies voltage between the rotating tool 1 and the surface treating electrode 2. The interpole detecting circuit 17 judges the interpole voltage or the short circuit by a voltage drop of an internal resistance of the power source 18. The power source 18 has a discharging resistor and the like, though not shown.

The rotating tool 1 is relatively moved to the surface treating electrode 2 vertically or in the Z-axis direction via the chuck 3. The electrode holder 4 is fixed at a predetermined position of the X-table 11. Thereby, the position of the electrode 2 can be controlled by the control unit 15 by moving the X-table 11 and the Y-table 12 in the X-axis direction and the Y-axis direction via the X-axis driver 13 and the Y-axis driver 14. The mounting position of the electrode holder 4 to the X-table 11 is adjusted so that the axis of the electrode 2 extends in the X-axis direction. Thus, the rotating tool 1 and the surface treating electrode 2 can controllably make a relative movement in one or two or three axis directions of the X-axis and Y-axis and Z-axis directions at once. In this embodiment, the electrode holder 4 holds the surface treating electrode 2 so that it extends perpendicularly to the Z-axis direction and parallel to the X-axis direction. However, the electrode holder 4 may be tiltable in a tilting direction (vertical direction) T with a fixed distance to the rotating tool 1. In this case, it is possible that a peripheral flank 1*a* of the rotating tool 1 is slanted at a predetermined angle to its center axis 0'0 (see FIG. 3).

The rotating shaft driver 8 and the Z-axis driver 7 constitute a relative movement driver for relatively moving the rotating tool 1 and the surface treating electrode 2 in this embodiment.

As shown in FIG. 2, the rotating tool 1 in this embodiment is provided with the peripheral flank 1*a* which is a surface having a relief angle (peripheral clearance angle) β located at a cutting edge portion of a cutting tooth. The rotating tool 1 has a rake face 1*b*, which is a surface defining a rake angle, placed next to the flank 1*a* with a tool angle γ. The tool 1 has a helical flute 1*c* which is formed into a predetermined plan shape such as a helical shape or a straight shape.

An operation of the surface treating apparatus of this embodiment is described hereafter.

The rotating tool 1 and the surface treating electrode 2 are relatively moved by the Z-axis driver 7, X-axis driver 13 and Y-axis driver 14, thereby setting their relative positions such that a discharge surface defined by an end surface 2*a* of the electrode 2 is faced parallel to the flank 1*a* of the tool 1 with a fixed gap. In case the rotating tool 1 has a peripheral flank of a curved shape such as an eccentric cutting edge made by an eccentric relief sharpening, the end surface 2*a* of the electrode 2 is set such that it becomes parallel to a plane including a tangent line of the curved flank. The above gap is a gap with which an electric discharge is generated between the flank 1*a* of the rotating tool 1 and the end surface 2*a* of the surface treating electrode 2. The position (initial set position) of the electrode 2, namely the Z-axis position of the end surface 2*a* at that time may be selected as desired. However, it is preferably an uppermost or lowermost end position of the flank 1*a*. The above position setting is performed by use of the control unit 15 and the interpole detecting circuit 17, for example.

Next, the tool 1 held by the chuck 3 is rotated by the rotating shaft driver 8 together with the rotating shaft 6 while vertically moved by the Z-axis driver 7 together with the main shaft 5. At this time, the vertical movement and the rotation of the tool 1 are synchronized by the control of the locus movement control circuit 16. The synchronizing operation is such that the discharge surface of the electrode 2 moves along a helical locus (helical angle θ) of the cutting edge of the machined tool 1. For that purpose, a rotating amount of the rotating shaft 6 is specified so as to correspond to a moving amount of the main shaft 5 (a feed amount by a predetermined cutting edge length in the axial direction of the tool 1). Such a specified amount are stored in the locus movement control circuit 16 as a parameter for operating the rotating tool 1.

An example of the above operation is described, in which a right hand helical tooth end mill of a helical angle θ, a cutting edge length L (mm) and a diameter D (mm) is processed.

Figure 3:
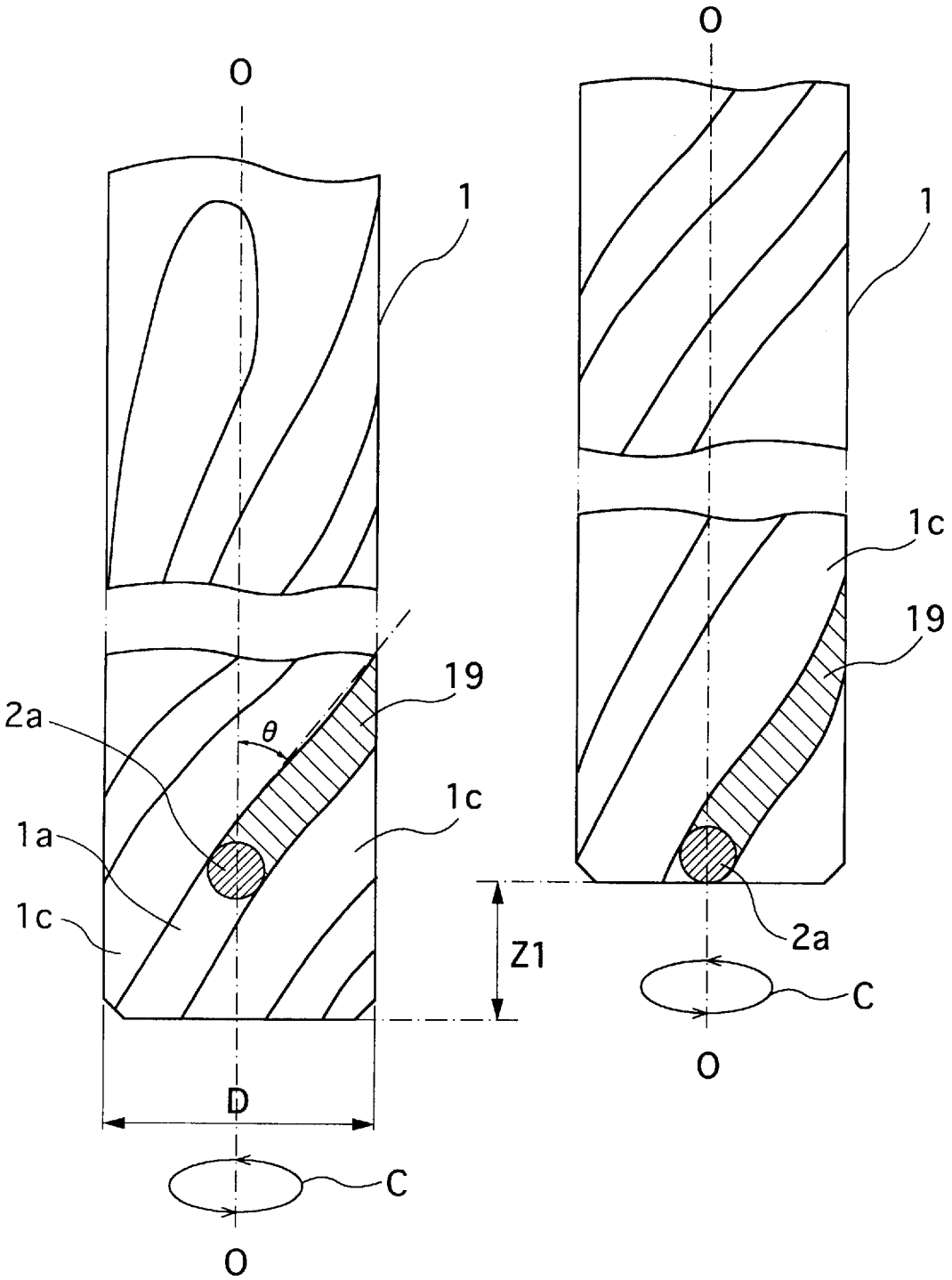
FIG. 3 is a front view showing a relative movement of the rotating tool and a surface treating electrode of the surface treating apparatus of the first embodiment.

If the main shaft 5 is moved in a minus direction (upward) of the axial direction (Z-axis direction) by a predetermined moving amount, i.e. by a moving amount of the cutting edge length L in a direction away from the leading end of the tool 1 toward the chuck 3, the tool 1 is kept moving in the minus direction (upward) while rotated rightward at a constant proportion of $(360° \times L \times \tan\theta)/(\pi \times D)$. For example, FIG. 3 illustrates a relative movement of the rotating tool and the surface treating electrode in the first embodiment of the surface treating apparatus. In FIG. 3, the tool 1 is moved upward, while rotated rightward when seen from the side of the end surface 2*a* of the electrode 2. Thereby, the end surface 2*a* as the discharge surface of the electrode 2 is relatively moved downward along the helix of the peripheral flank 1*a* of the tool 1. As a result, the reforming layer 19 is built along the length of the flank 1*a* by a distance Z1 of the downward movement of the end surface 2*a*. If the main shaft 5 is moved in a plus direction (downward) of the Z-axis direction, i.e. away from the chuck 3 to the leading end of the tool 1, the tool 1 is rotated in a reverse direction to the above (left-handed rotation). Thus, the discharge surface of the electrode 2 is reciprocated on the peripheral flank 1*a* along the helix of the cutting tooth while keeping the positional relationship of the processing start time (initial set position) shown in FIG. 2. The interpole detecting circuit 17 detects the positional relationship between the electrode 2 and the rotating tool 1 by their contact or the like. A detected information is sent to the control unit 15. This information is used for positioning the discharge surface of the electrode 2 and the flank 1*a* and face 1*b* of the tool 1 (see FIG. 2) so that they are opposed to each other. When the helical angle θ, processed cutting edge length L, diameter D, information of helical cutting tooth (right-hand or left-hand), moving speed and number of moving times are input in the locus movement control circuit 16, it gives the control unit 15 a command that the discharge surface traces the helix of the flank 1*a*. The control unit 15 controls the X-axis driver 13, Y-axis driver 14, Z-axis driver 7 and rotating shaft driver 8 in accordance with the command so as to make the tool 1 and electrode 2 relatively moved as desired.

As mentioned above, the power source 18 applies voltage to generate electric discharge between the tool 1 and the electrode 2, while the discharged portion being dipped in the working fluid 10 and while the electrode 2 traces the processed cutting tooth surface. Thus, a reforming layer 19 is built on the peripheral flank 1*a* and the rake face 1*b* of the rotating tool 1. Namely, the reforming layer 19 formed on the flank 1*a* extends along an outer circumferential edge part of the face 1*b*, thereby defining the reforming layer 19 also on the face 1*b*.

In the first embodiment, it is preferable to control the electrode holder 4 to move in the axial direction of the electrode 2 (X-axis direction), thereby correcting the position of the end surface 2*a* of the electrode 2, which is worn by the electric discharge. In this case, the discharge gap between the end surface 2*a* of the electrode 2 and the cutting tooth of the tool 1 is always kept suitable for electric discharge.

Second Embodiment

Figure 4:
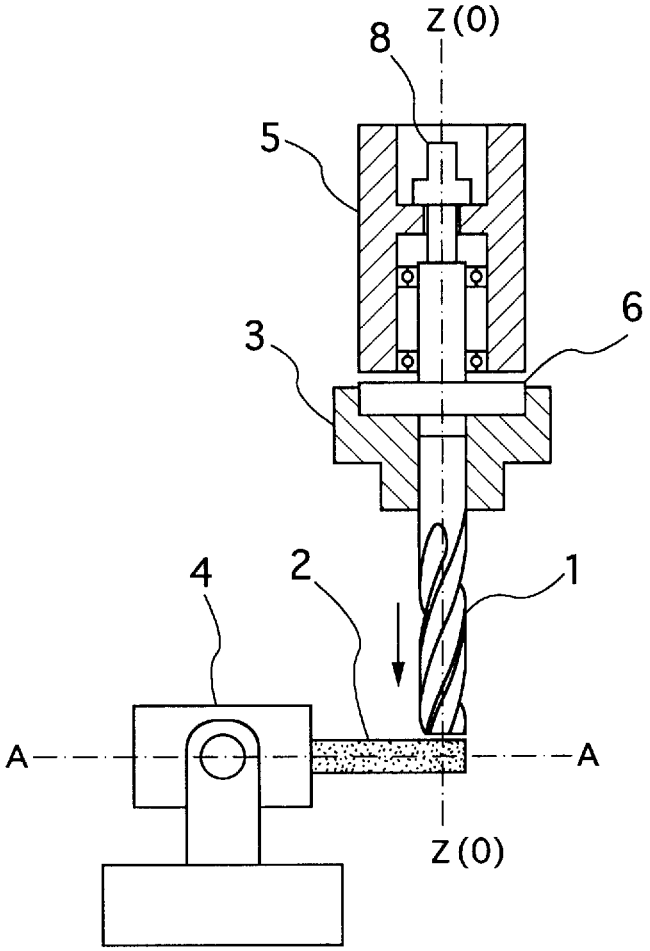
FIG. 4 is a front view showing a relation between a rotating tool and a surface treating electrode in a surface treating apparatus of a second embodiment of the invention.
Figure 5:
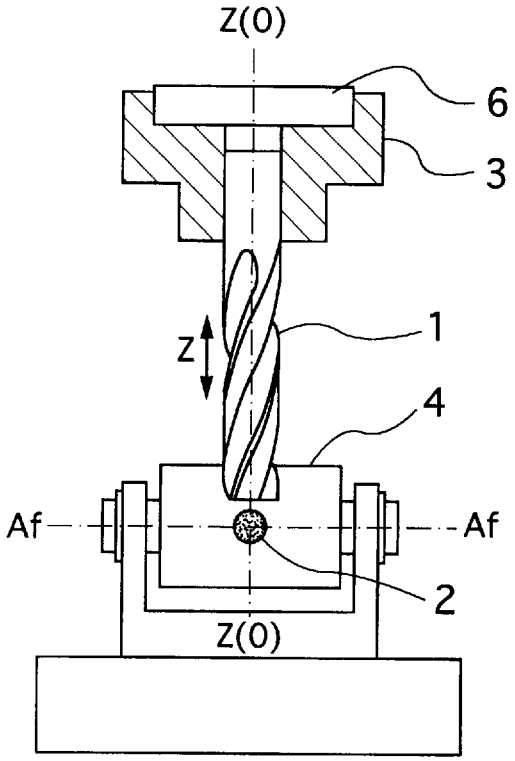
FIG. 5 is a side view showing a relation between the rotating tool and the surface treating electrode of FIG. 4.
Figure 6:
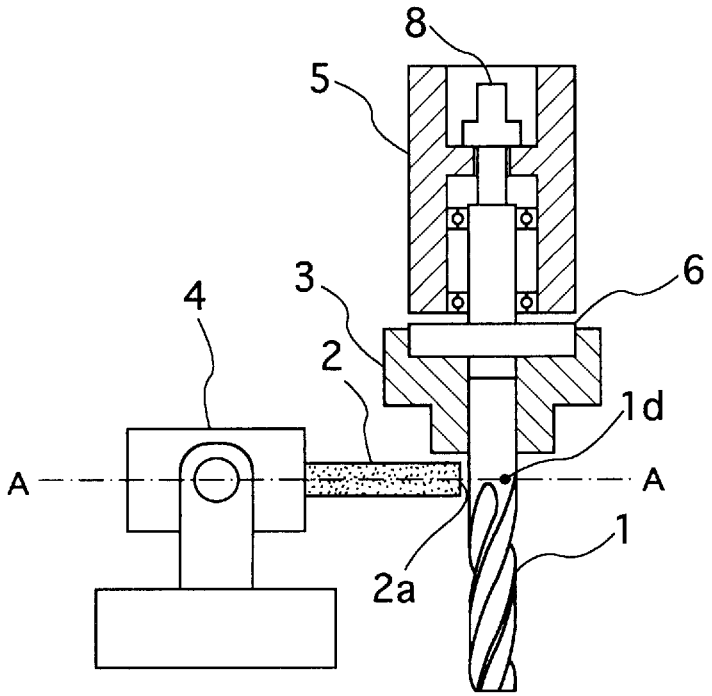
FIG. 6 is a front view showing a state after a positional relationship between the rotating tool and the surface treating electrode is changed.
Figure 7:
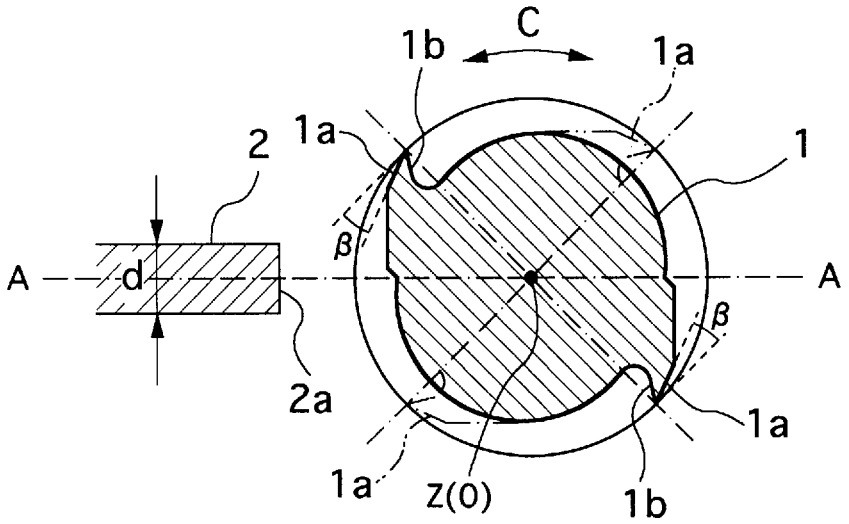
FIG. 7 is an explanatory sectional view showing a positional relationship between a center axis of a rotating tool and a surface treating electrode, on a horizontal plane, according to the second embodiment of a surface treating apparatus by electric discharge machining of the invention.
Figure 8:
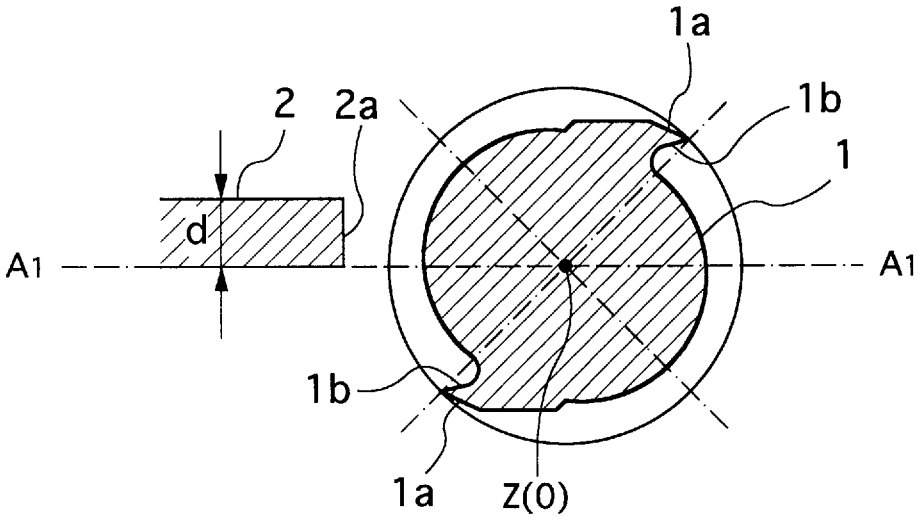
FIG. 8 is an explanatory sectional view showing a positional relationship between the rotating tool and an outside diameter line of the surface treating electrode on the horizontal plane.
Figure 9:
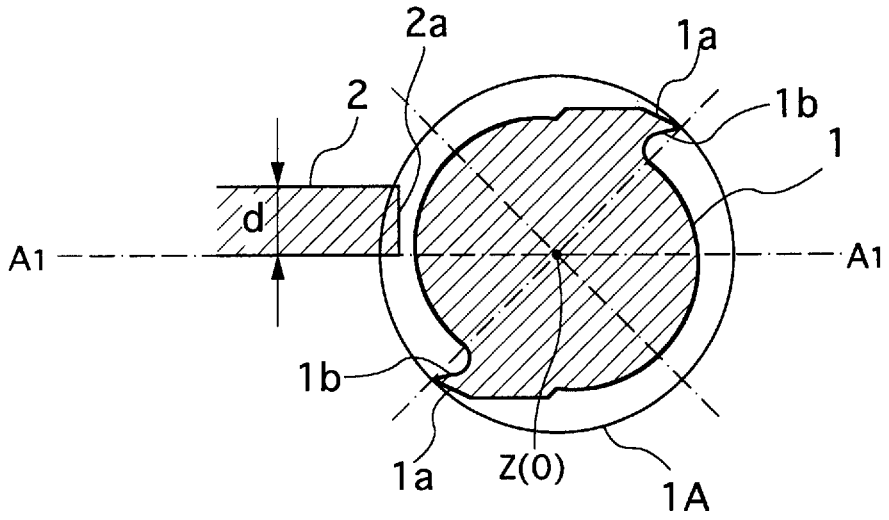
FIG. 9 is an explanatory sectional view showing a positional relationship between the rotating tool and an outside diameter line of the surface treating electrode on the horizontal plane, wherein the electrode advances inside a rotational locus of a cutting edge.
Figure 10:
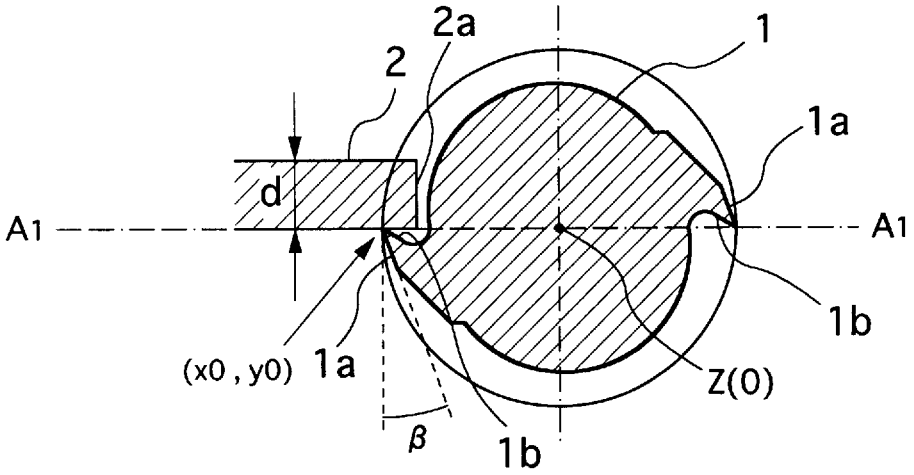
FIG. 10 is an explanatory sectional view showing a positional relationship between the rotating tool and an outside diameter line of the surface treating electrode on the horizontal plane, wherein the electrode is contacted with the cutting edge.
Figure 11:
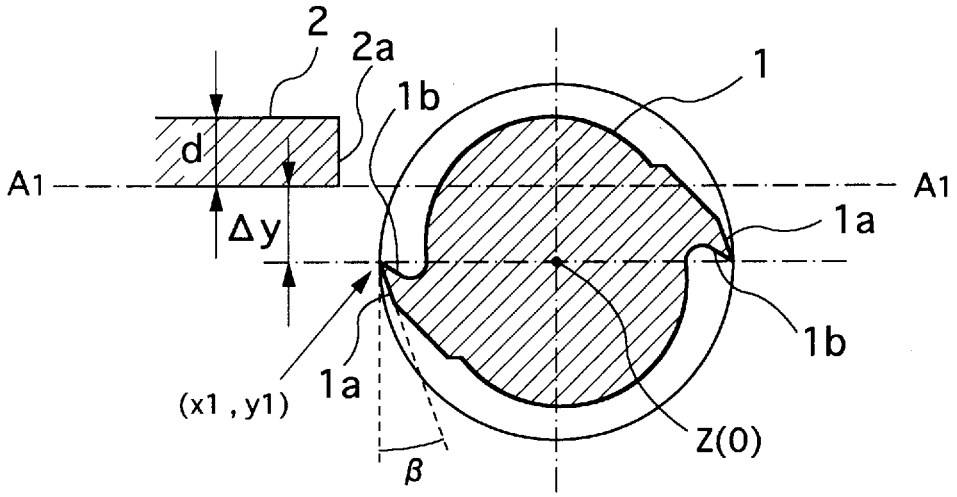
FIG. 11 is an explanatory sectional view showing a positional relationship between the cutting edge of the rotating tool and an outside diameter line of the surface treating electrode.
Figure 12:
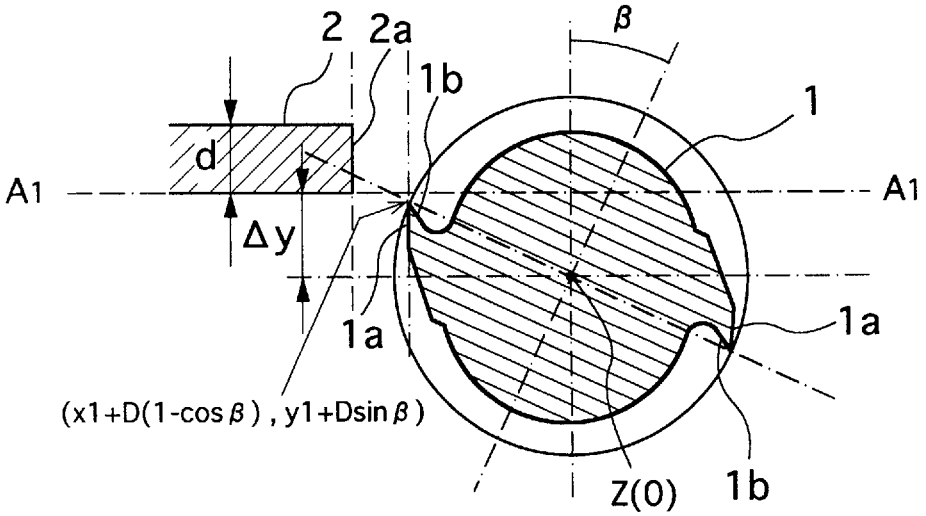
FIG. 12 is an explanatory sectional view showing an angular relationship between a peripheral flank of the rotating tool and a longitudinal end surface of the surface treating electrode.
Figure 13:
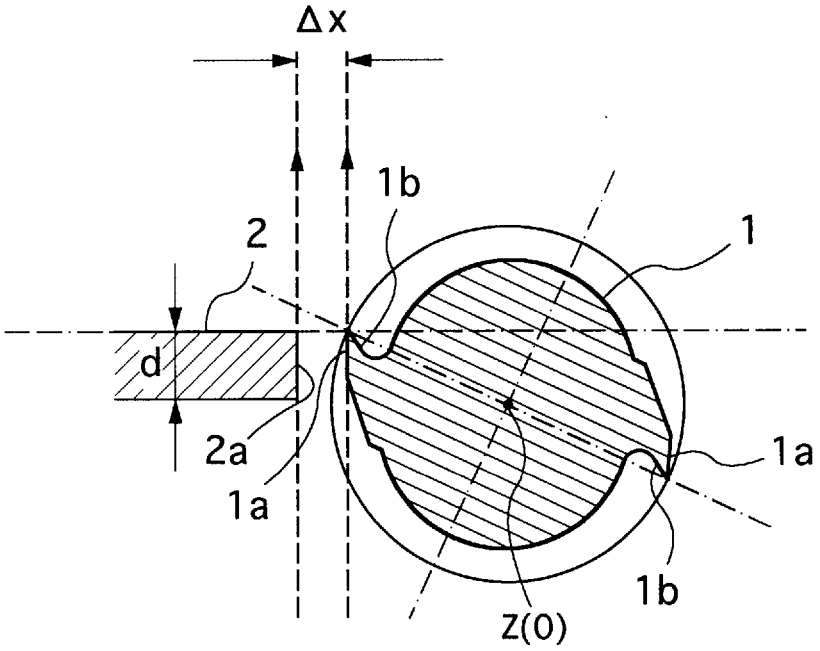
FIG. 13 is an explanatory sectional view showing a parallel relationship between a peripheral flank of the rotating tool and a longitudinal end surface of the surface treating electrode.
Figure 14:
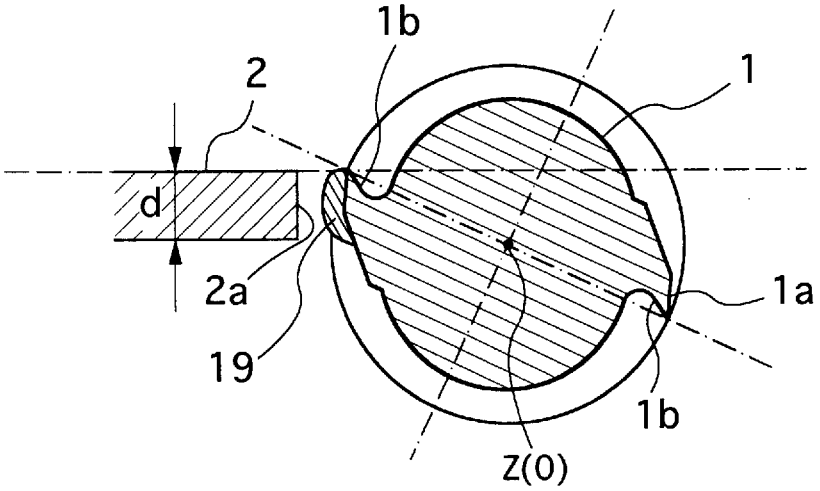
FIG. 14 is an explanatory view of an operation for building a reforming layer on the peripheral flank of the rotating tool.

FIG. 4 illustrates a relation between a rotating tool and a surface treating electrode in a surface treating apparatus of a second embodiment of the invention. FIG. 5 illustrates a relation between the rotating tool and the surface treating electrode of FIG. 4. FIG. 6 illustrates a state after a positional relationship between the rotating tool and the surface treating electrode is changed. FIG. 7 illustrates a positional relationship between a center axis of a rotating tool and a surface treating electrode, on a horizontal plane, according to a second embodiment of a surface treating apparatus by electric discharge machining of the invention. FIG. 8 illustrates a positional relationship between the rotating tool and an outside diameter line of the surface treating electrode on the horizontal plane. FIG. 9 illustrates a positional relationship between the rotating tool and an outside diameter line of the surface treating electrode on the horizontal plane, wherein the electrode advances inside a rotational locus of a cutting edge. FIG. 10 illustrates a positional relationship between the rotating tool and an outside diameter line of the surface treating electrode on the horizontal plane, wherein the electrode is contacted with the cutting edge. FIG. 11 illustrates a positional relationship between the cutting edge of the rotating tool and an outside diameter line of the surface treating electrode. FIG. 12 illustrates an angular relationship between a flank of the rotating tool and a longitudinal end surface of the surface treating electrode. FIG. 13 illustrates a parallel relationship between a flank of the rotating tool and a longitudinal end surface of the surface treating electrode. FIG. 14 explains an operation for building a reforming layer on the flank of the rotating tool.

An entire structure of the second embodiment of the surface treating apparatus is same as the apparatus shown in FIG. 1, and its detailed description is omitted.

Referring to FIGS. 4 to 14, the surface treating apparatus of the second embodiment has the rotating tool 1, surface treating electrode 2, chuck 3, electrode holder 4, main shaft 5, rotating shaft 6, Z-axis driver 7 and rotating shaft driver 8, as the first embodiment.

An operation of the surface treating apparatus of the second embodiment is described hereafter referring to FIGS. 4 to 14 and FIGS. 15 and 16.

Figure 15:
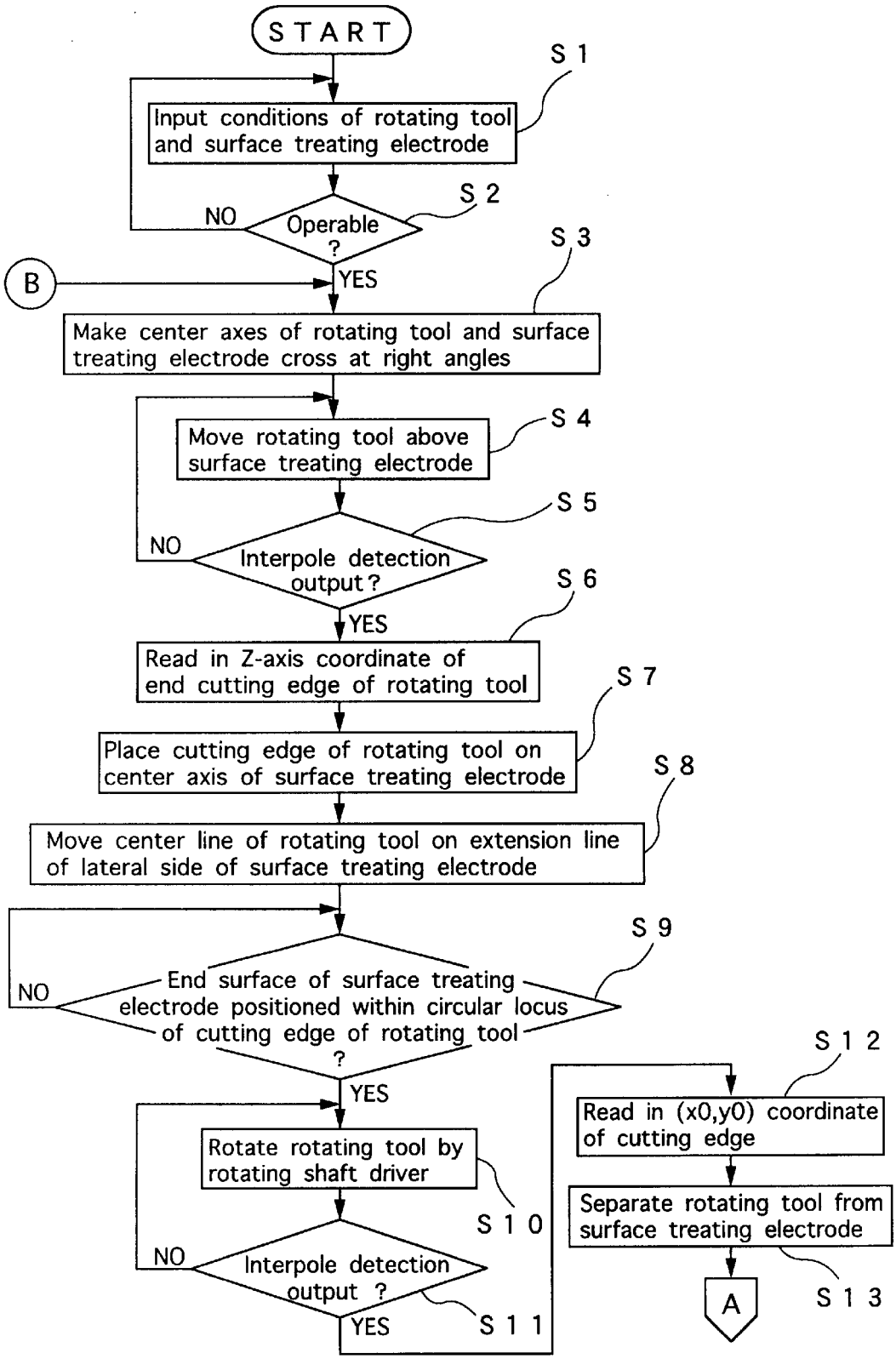
FIG. 15 is a first part of a flowchart of a program for building the reforming layer while setting a relation between the rotating tool and the surface treating electrode in the second embodiment of the surface treating apparatus.
Figure 16:
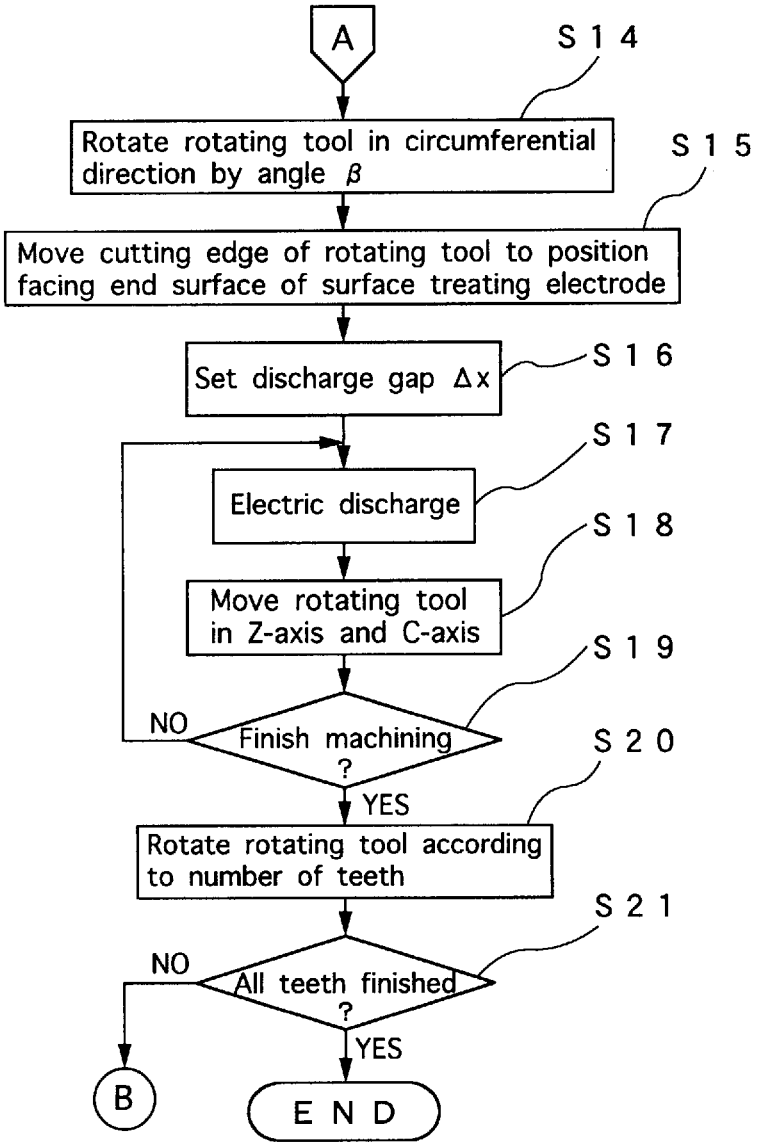
FIG. 16 is a second part of the flowchart of the program for building the reforming layer while setting a relation between the rotating tool and the surface treating electrode in the second embodiment of the surface treating apparatus.

FIGS. 15 and 16 illustrate a flowchart of a program for building the reforming layer while setting a relation between the rotating tool and the surface treating electrode in the second embodiment of the surface treating apparatus.

In step S1, conditions or data of the tool 1 and the electrode 2 are input and set in the control unit 15. The conditions of the rotating tool 1 are a helical angle θ, cutting edge length L (mm), diameter D (mm), helical direction (right-hand or left-hand) and the like. The conditions of the surface treating electrode 2 are a length M (mm), diameter d (mm) and the like. The position of the electrode holder 4, which is adapted for holding the electrode 2 as a mechanical structure, is unequivocally determined when the holder 4 is mounted on the processing vessel 9. Then, the X-coordinate and Y-coordinate of the holder 4 can be specified, while the Z-coordinate thereof is specified. Therefore, the position of the center line A—A of the electrode fitted to the electrode holder 4 is unequivocally determined. Moreover, the levelness of the electrode 2 is determined by the mechanical mounting, so that the Y-coordinate can be specified while the X-coordinate is specified. The center line O—O of the rotating tool 1 (see FIGS. 4 and 5) is unequivocally determined by the center line (axis) Z—Z extending in the Z-axis direction of the main shaft 5, so that the X-coordinate and Y-coordinate thereof are specified.

As shown in FIG. 4, even when the electrode 2 and the tool 1 are mounted at their positions, it is not specified where the center line A—A of the electrode 2 and the center line O—O of the tool 1 (center line Z—Z of the main shaft 5) are positioned. However, the position of the center line A—A of the electrode 2 is mechanically determined and can be specified. Moreover, the position of the center line O—O of the tool 1 is mechanically decided and can be specified. Accordingly, as shown in FIG. 5, the positional relationship of the tool 1 (right-handed helical tooth and four teeth end mill) held on the chuck 3 and the electrode 2 held on the holder 4 can be set such that the center line A—A of the electrode 2 and the center line O—O of the tool 1 cross at right angles, by adjusting the position of the electrode holder 4 through the X-axis driver 13 and Y-axis driver 14. Then, in step S2, operation keys, which are provided corresponding respectively to the drivers 7, 13 and 14 on a control panel not shown, are operated. In step S3, the position of the electrode holder 4 is adjusted so that the center line O—O of the tool 1 crosses perpendicularly to the center line A—A of the electrode 2. A horizontal plane Af—Af including the center line A—A is shown in FIG. 5. At this time, their positions are set such that the tool 1 and the electrode 2 are spaced with a little interval so as not to collide with each other, as shown in FIGS. 4 and 5, on the basis of the cutting edge length L (mm) of the tool 1, the length M (mm) and diameter d (mm) of the electrode 2 and the like.

In step S4 and step S5, the rotating tool 1 is lowered, and the interpole detecting circuit 17 detects whether or not a longitudinal end cutting edge portion of the tool 1 contacts with an upper portion of the electrode 2. When the end cutting edge portion touches the upper portion of the electrode 2, the Z-coordinate of the end cutting edge at that time is calculated as a standard position, on the basis of a distance d/2 between the position of the end cutting edge and the center line A—A of the electrode 2, in step S6. At this time, since the Z-coordinate of the center line A—A of the electrode 2 is mechanically determined and specified, as mentioned above, such a calculation of the standard position is possible.

Thereafter, in step S7, the rotating tool 1 is moved upward and retracted up to such a position as not to interfere with the electrode 2, and the electrode 2 is also moved backward. Then, as shown in FIG. 6, the rotating tool 1 is lowered in the Z-axis direction by the Z-axis driver 7, on the basis of the cutting edge length of the tool 1, so that an end of the cutting edge at a shank side of the tool 1 or a neck position 1*d* is faced to the end surface 2*a* of the electrode 2 and positioned on an extended line of the center line A—A.

When seeing the section of the tool 1 on the horizontal plane Af—Af from the chuck 3 side, the positional relationship of the end surface 2*a* and the flank 1*a* is as shown in FIG. 7, for example. Namely, there are two cases: one in which the cutting edge of the tool 1 is rotated rightward (clockwise) from the center line A—A of the electrode 2 as shown by the solid line in FIG. 7, and the other in which the cutting edge of the tool 1 is rotated leftward (counterclockwise) from the center line A—A of the electrode 2 as shown by the two-dot chain line in FIG. 7.

As shown in FIG. 8, in step S8, the electrode 2 is moved in the X-axis and Y-axis directions to adjust the relative position with the rotating tool 1 so that an extended line Al—Al of one end in the width direction of the end surface 2*a* (lowermost end in FIG. 8) passes or crosses perpendicularly to the center axis 0 of the rotating tool 1. The extended line Al—Al is located at the left end (lower end in FIG. 8) seen from the end surface 2*a* side of the electrode 2 if the helix of the tool 1 is right-hand as shown in FIG. 8. If the helix of the tool 1 is left-hand, it is located at the right end (upper end in FIG. 8) seen from the end surface 2*a* side of the electrode 2. Namely, if the electrode 2 is a round bar, it is an extended line of a tangent line of the leftmost or rightmost peripheral surface. If the electrode 2 is a square bar, it is an extended line of the leftmost or rightmost end surface. The extended line Al—Al of the electrode 2 can be obtained and recognized by detecting contact of the side surface of the electrode 2 and the shank part of the tool 1 through the interpole detecting circuit 17. In this embodiment, the extended line Al—Al is the one which is calculated by the center line A—A and the radius d/2 of the electrode 2 for convenience sake. The center line O—O (center axis O) at that time is measured by the moving amount of the X-table 11 and Y-table 12.

As shown in FIG. 9, the electrode 2 is moved in the X-axis direction so that the end surface 2*a* is disposed at such a position as to be inside a locus 1A of the cutting edge of the tool 1 and not to contact the tool 1. It is decided in step S9 whether or not the electrode 2 comes to such a position. Namely, it is decided YES when the end surface 2*a* is placed inside a range of D/2 from the center line O—O of the tool 1 while the interpole detecting circuit 17 does not detect the contact of the electrode 2 and the tool 1. Thereafter, in step S10, the tool 1 is rotated clockwise (right turn in FIGS. 4 to 14) in case of the right-hand helical tooth or counterclockwise in case of the left-hand helical tooth. In step S11, as shown in FIG. 10, the electrode 2 and the tool 1 are contacted with each other. At this time, the interpole detecting circuit 17 detects the contact of the side surface of the electrode 2 with the cutting edge of the tool 1. In step S12, the control unit 15 reads in a coordinate (x0, y0) of the cutting edge of the cutting tooth which is contacted with the electrode 2 at that time, among the plural teeth (two teeth in the illustrated embodiment) of the tool 1. Such a coordinate (x0, y0) of the cutting edge can be calculated on the basis of the coordinate of the center line O—O and radius D/2 of the tool 1 and a distance from the end surface 2*a* of the electrode to the center line O—O of the tool 1. The coordinate (x0, y0) of the above contacted tooth among the plural teeth can be a provisional coordinate for the later steps such as a positioning, i.e. a coordinate of a virtual cutting edge. That is, the coordinate of the virtual cutting edge can be a coordinate of the cutting edge of the tooth which is read out from the center coordinate O of the tool 1 and of which the interpole detecting circuit 17 detects the contact with the side surface of the electrode 2, among the plural teeth of the tool 1. Such a coordinate may be a coordinate (x0=0, y0=0) and used for the later steps. At any rate, it is enough if the coordinate of the cutting edge of the tool 1 is specified. In this embodiment, the coordinate (x0, y0) of a specific tooth cutting edge is read in, and used for the later steps.

The rotating shaft 6 is stopped rotating in the above contact state and kept at such a position in the rotating direction (referred to "C coordinate" hereafter). In this state, the electrode 2 is moved upward in the FIGS. 11 and 12 so that the tool 1 is moved relatively away from the extended line Al—Al of the electrode 2 or in the Y-axis direction up to such a position as not to interfere with the electrode 2, in step S13. Moreover, the electrode 2 is moved in the X-axis direction, too, by a predetermined distance. At this time, as shown in FIG. 11, if the moving amount from the electrode 2 is $\Delta y$, the coordinate of the cutting edge of the tool 1 becomes a coordinate (x1, y1). Such a coordinate (x1, y1) of the tool 1 represents a relative coordinate to the electrode 2. In the state of FIG. 11, a cutting tooth surface or the peripheral flank 1*a* is slanted by a degree of the peripheral relief angle $\beta$ of the tooth of the tool 1. Therefore, if the electrode 2 is moved parallel in the Y-axis direction in relation to the cutting edge so that the cutting edge is opposed to the end surface 2*a* of the electrode 2 so as to perform the electric discharge, the reforming layer 19 is built so as to cover the cutting edge from the flank 1*a* to the face 1*b*, thereby making the cutting edge rounded and dull.

Then, in step S14, the tool 1 is rotated in the C axis direction, by the degree of the peripheral relief angle $\beta$ of the cutting edge, up to a predetermined C coordinate through the rotating shaft 6. Thus, the flank 1*a* to be processed is set at a position opposite and parallel to the end surface 2*a* of the electrode 2. Here, the peripheral relief angle $\beta$ actually defining the flank 1*a* of the tool 1 is different depending on the tool diameter D or manufacturers who make the tool. Then, the peripheral relief angle $\beta$ is obtained from a table of peripheral relief angles or the like which the tool manufacturer issues and which is used at the time of re-grinding. Such relief angles are input into the control unit 15 so that the cutting tooth is positioned rightward in case of the right hand helical tooth and leftward in case of the left hand helical tooth. Then, the rotating shaft 6 is rotated by the rotating shaft driver 8 as mentioned above, and an appropriate correction is made so that the end surface 2*a* of the electrode 2 and the flank 1*a* of the tool 1 become parallel.

In this embodiment, since the tool 1 has the diameter D, the coordinate of the cutting edge is changed from the coordinate (x1, y1) to the coordinate $\{x1+D(1-\cos\beta), y1+D\times\sin\beta\}$ after rotating the tool 1 by the relief angle $\beta$. Here, if $y1=y0-\Delta y$, the coordinate becomes $\{x1+D(1-\cos\beta), y0-\Delta y+D\times\sin\beta\}$.

In step S15, the rotating tool 1 is moved in the Y-axis direction by an amount $d-(y0-\Delta y+D\times\sin\beta)$ so that the cutting edge is placed at the same position as one corner edge of the end surface 2*a* of the electrode 2 (upper corner edge in FIG. 13) or outward therefrom (upward in FIG. 13). Thereby, the cutting edge is prevented from getting dull by the reforming layer 19 built thereon. Thus, as shown in FIG. 13, it is possible to position the cutting edge of the tool 1 to the end surface 2*a* of the electrode 2 while preventing the electrode 2 from being disposed beyond the cutting edge. In step S16, the rotating tool 1 and the end surface 2*a* of the electrode 2 are positioned so that the gap becomes $\Delta x$. Thereafter, in step S17, an electric discharge is generated between the peripheral flank 1*a* of the tool 1 and the electrode 2. In step S18, as described in the first embodiment, the tool 1 is rotated in the C-axis direction while moved in the Z-axis direction. Namely, the relative movement of the electrode 2 and the tool 1 is controlled so that the discharge surface of the electrode 2 and the processed surface of the cutting edge of the tool 1 maintain the same positional relationship all the time. The electric discharge machining is performed simultaneously so as to form the reforming layer 19 uniformly on the peripheral flank 1*a* along the entire cutting edge length L of the cutting tooth. In step S19, it is decided whether or not the reforming layer 19 was built uniformly on the flank 1*a* for the entire cutting edge length L of the tool 1. In step S20, the tool 1 is rotated by a predetermined angle according to the number of teeth so as to position a next processed cutting edge, e.g. a cutting edge adjacent to the last processed cutting edge, to the electrode 2 in the same manner as the above. In step S22, it is decided whether or not the processing was carried out by the times of the teeth number of the rotating tool 1. If the processing was not performed by the times of the teeth number, the execution returns to the routine from step S3, and the same operation is repeated. If it is decided that the processing was performed by the times of the teeth number of the tool 1 in step S21, the execution exits this routine.

If the cutting edge portion is machined by a large electric discharge energy, the tool 1 may be moved more in the Y-axis direction than the case of FIG. 14 so as to be disposed beyond the corner edge of the electrode 2. In this case, it is possible to make up the reforming layer 19 on the cutting edge by the electric discharge machining, while restraining it from getting dull.

With the above method of positioning the cutting edge of the tool 1 to the end surface 2*a* of the electrode 2, it it is possible to automatically position the electrode 2 to the tool 1 only by inputting the peripheral relief angle β, cutting edge length L and diameter D of the tool 1 and the diameter d of the electrode 2 in the control unit 15, even if the diameter D of the tool 1 to be processed is different.

Moreover, the end surface 2*a* of the electrode 2 can be positioned even to a cutting tooth surface of the rotating tool 1 such as a reamer which has no helical cutting tooth but a straight cutting tooth extending in its axial direction. Then, it is possible to make the electrode 2 follow the tooth surface of each straight cutting edge, thereby building a uniform reforming layer 19 thereon.

Third Embodiment

Figure 17:
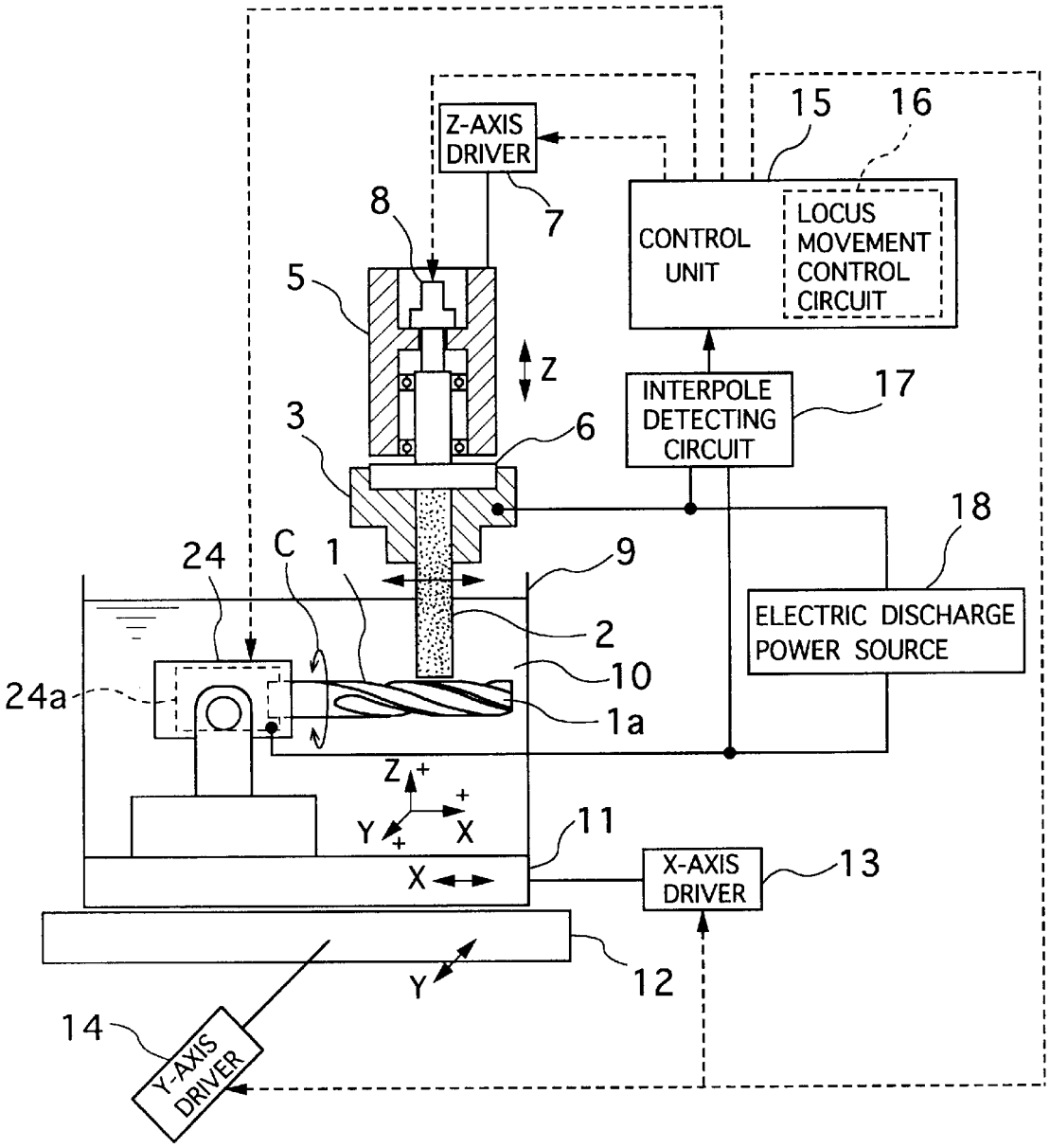
FIG. 17 is a schematic view showing an entire structure of a surface treating apparatus by electric discharge machining according to a third embodiment of the invention.

FIG. 17 illustrates an entire structure of a surface treating apparatus by electric discharge machining according to a third embodiment of the invention.

As shown in FIG. 17, the third embodiment has a similar structure to that of the first embodiment as a whole, but reverses the positional relationship between the rotating tool 1 and the surface treating electrode 2. Namely, the surface treating electrode 2 is held by the chuck 3 so as to be rotated through the rotating shaft 6 by the rotating shaft driver 8. The electrode 2 is moved in the Z-axis direction through the main shaft 5 with its position controlled by the control of the control unit 15, in the same manner as the rotating tool 1 of the first embodiment.

On the other hand, the rotating tool 1 is held coaxially on an electrode holder 24. The electrode holder 24 is fixed on a predetermined position of the X-table 11 as the electrode holder 4 of the first embodiment. The electrode holder 24 is set such that its axis extends horizontally on the X-table 11. Thus, the axis of the rotating tool 1 also extends horizontally on the X-table 11. Thereby, the rotating tool 1 is controllably moved in the X-axis direction or Y-axis direction in relation to the surface treating electrode 2, in the same manner as the control of movement of the electrode 2 in the first embodiment. Moreover, the electrode holder 24 accommodates therein a motor 24*a* for rotating the tool 1, in addition to the same structure as the electrode holder 4 of the first embodiment. Then, the rotating speed of the tool 1 is controlled through the motor 24*a* by the control unit 15 and locus movement control circuit 16, in the same manner as the rotation control for the rotating shaft driver 8 in the first embodiment.

The electrode holder 24 including the motor 24*a*, X-axis driver 13 and Y-axis driver 14 constitute a relative movement driver for relatively moving the rotating tool 1 and the surface treating electrode 2 in the third embodiment.

An operation of the surface treating apparatus of the third embodiment is described hereafter.

In the third embodiment, the surface treating electrode 2 is moved in the Z-axis direction, while the rotating tool 1 is moved in the X-axis and Y-axis directions, both under a controlled state. Then, the end surface 2*a* of the electrode 2 is faced to the cutting edge of the tool 1 by use of the interpole detecting circuit 17, in the same manner as the first embodiment. Thereafter, an electric discharge is generated between the tool 1 and electrode 2 by the electric discharge power source 18. Simultaneously, an X-axis feed of the tool 1 is controlled while its rotation in the C-axis direction is controlled so as to synchronize with the X-axis feed. Thus, the end surface 2*a* of the electrode 2 follows and traces the entire length of the cutting edge of the tool 1.

More in detail, the surface treating electrode 2 is held by the chuck 3 and mounted on the main shaft 5. The rotating tool 1 is fitted to the electrode holder 24 and drivingly coupled to the motor 24*a* so as to be rotatable. The electrode holder 24 is disposed in the processing vessel 9, which is filled with the working fluid 10, so as to be movable with the X-table 11 and Y-table 12. The control unit 15 controls rotation of the motor 24*a* and operations of the X-axis driver 13 and Y-axis driver 14. Thus, it controls the X-axis position and Y-axis position of the electrode holder 24 via the X-table 11 and Y-table 12. The surface treating electrode 2 is set such that the end surface 2*a* is faced to the peripheral flank 1*a* of the cutting tooth of the tool 1. Moreover, the X-table 11 and/or Y-table 12 is controlled to move the tool 1 horizontally, too, via the electrode holder 24. The horizontal movement and rotation thereof are synchronized at that time. For the synchronizing operation, the moving amount in the axial direction (X-axis direction) and the rotating amount of the tool 1 are adjusted so that the discharge surface or the end surface 2*a* of the electrode 2 moves along the helix of the cutting edge of the tool 1 to be machined by the electric discharge. The above operation is carried out by the control of the control unit 15 and locus movement control circuit 16, in the same manner as the first embodiment. For example, in case of processing a right-hand helical tooth end mill of a helical angle θ, cutting edge length L (mm) and diameter D (mm), if the axial direction is the X-axis direction and the end mill is rotated in the minus direction and if the moving amount equals to the cutting edge length L, the end mill is operated to rotate in the minus direction at a rate of $(360° \times L \times \tan \beta)/(\pi \times D)$ relative to the axial movement.

If the rotating tool 1 is moved in the plus direction of the X-axis, it is rotated in the reverse direction (plus direction). Thus, the discharge surface of the electrode 2 is reciprocated on the peripheral flank 1*a* and rake face 1*b* along the helix of the cutting edge, while keeping the positional relationship therewith at the start time of processing.

Namely, in the third embodiment, the operation of the rotating tool 1 and surface treating electrode 2 is reversed. Naturally, in this embodiment, an electrode polarity in setting an electrical condition for the electric discharge is opposite to that of the first embodiment.

Then, as in the first embodiment, an electric discharge is generated while the electrode 2 traces the tooth surface of the tool 1, so that the reforming layer 19 is built on the peripheral flank 1*a* of the tool 1.

Fourth Embodiment

Figure 18:
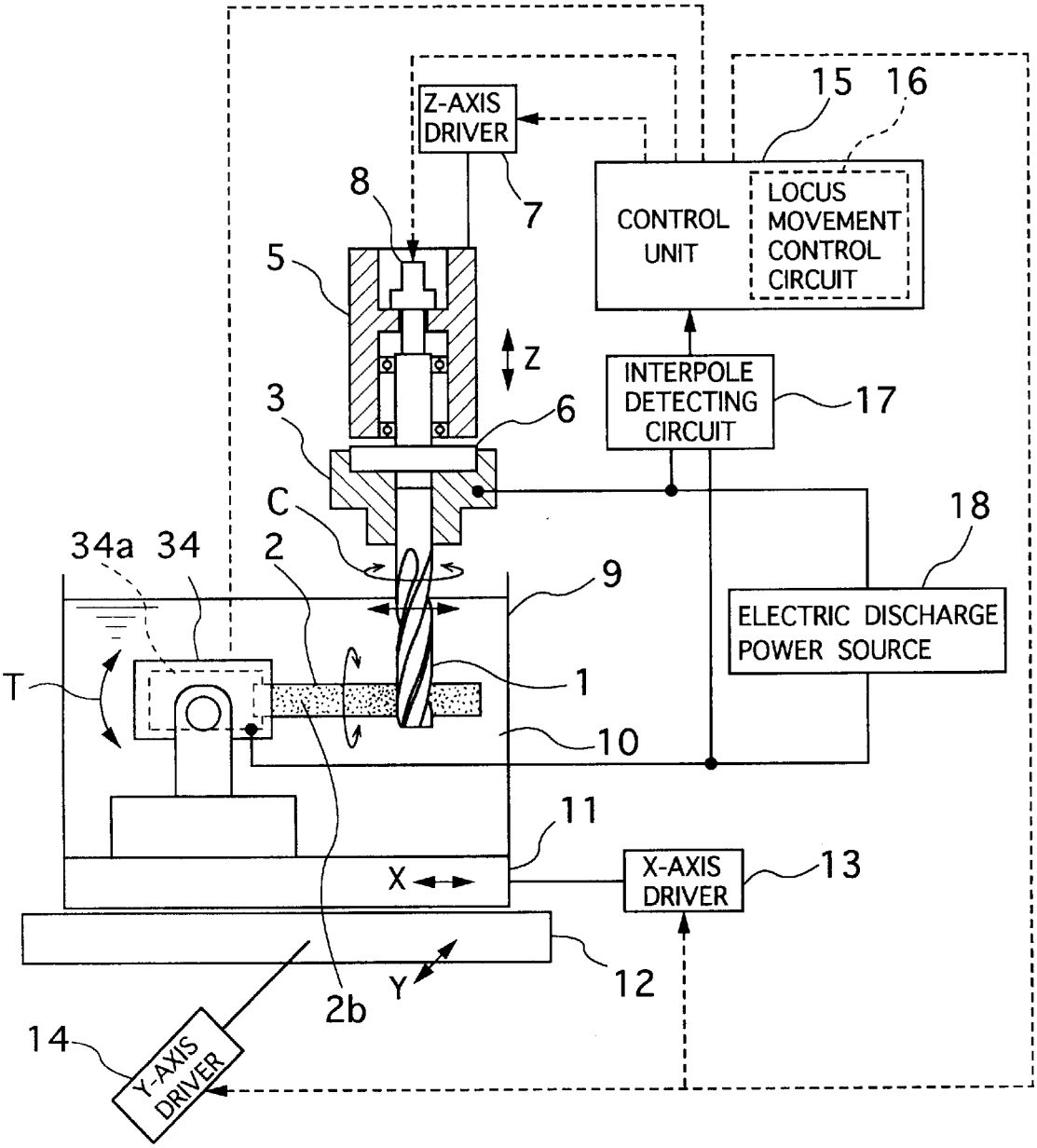
FIG. 18 is a schematic view showing an entire structure of a surface treating apparatus by electric discharge machining according to a fourth embodiment of the invention.

FIG. 18 illustrates an entire structure of a surface treating apparatus by electric discharge machining according to a fourth embodiment of the invention.

As shown in FIG. 18, the fourth embodiment has a similar structure to the first embodiment as a whole, however, it uses a peripheral surface of the surface treating electrode 2 as a discharge surface. Namely, the surface treating electrode 2 is held coaxially on an electrode holder 34. The electrode holder 34 is fixed on a predetermined position of the X-table 11 as the electrode holder 4 of the first embodiment. The electrode holder 34 is set such that its axis extends horizontally on the X-table 11. Thus, the axis of the surface treating electrode 2 also extends horizontally on the X-table 11. Thereby, the position of the electrode 2 is controlled by moving the X-table 11 and Y-table 12 in the X-axis and Y-axis directions via the X-axis driver 13 and Y-axis driver 14 by the control unit 15, as in the first embodiment. Therefore, the tool 1 and electrode 2 are controllably moved at the same time in one or two or three axis directions of the X-axis, Y-axis and Z-axis directions. The electrode holder 34 accommodates therein a motor 34*a* for rotating the electrode 2, in addition to the same structure as the electrode holder 4 of the first embodiment. Then, the rotation of the motor 34*a* is controlled by the control unit 15. The electrode holder 34 may be made tiltable in a tilting direction (vertically) T like the holder 4 of the first embodiment, so that the flank 1*a* of the tool 1 is inclined to the center axis at a predetermined angle.

The electrode holder 34, X-axis driver 13 and Y-axis driver 14 as well as the Z-axis driver 7 and rotating shaft driver 8 constitute a relative movement driver for relatively moving the rotating tool 1 and surface treating electrode 2 in the third embodiment.

An operation of the surface treating apparatus of the fourth embodiment is described hereafter.

In the fourth embodiment, the rotating tool 1 is rotated with the rotating shaft 6 through the chuck 3 by the rotating shaft driver 8, while being vertically moved with the main shaft 5 by the Z-axis driver 7. At this time, the vertical movement and the rotation of the tool 1 are synchronized by the control of the control unit 15 and the locus movement control circuit 16. For the synchronizing operation, the Z-axis moving amount of the main shaft 5 and the rotating amount of the rotating shaft 6 are set so that the peripheral surface 2*b* as a discharge surface of the electrode 2 moves along the helix of the cutting edge of the tool 1. For example, in case of processing a right-hand helical tooth end mill of a helical angle θ, cutting edge length L (mm) and diameter D (mm), the end mill is rotated in the minus direction at a rate of $(360° \times L \times \tan\theta)/(\pi \times D)$ for the moving amount of the main shaft 5 in the minus (upward) direction corresponding to the cutting edge length L. If the end mill is moved in the plus (downward) direction of the main shaft 5, it is rotated in the reverse direction (plus direction) to the above.

Moreover, the surface treating electrode 2 is rotated by the motor 34*a* of the holder 34. However, it is enough to rotate the electrode 2 at a fixed constant speed, contrary to the rotation of the tool 1 to be machined by electric discharge. The rotating speed thereof is preferably one which makes uniform an electric discharge wear of the peripheral surface 2*b* of the electrode 2 and which does not affect the electric discharge. Then, the discharge surface or the peripheral surface 2*b* extending along the length of the electrode 2 is reciprocated over the peripheral flank 1*a* along the helix of the cutting edge, while keeping the same positional relationship with the flank 1*a* as that of the machining start time. Moreover, it is preferable to give such a relative movement as the tool 1 is reciprocated in the axial direction along the electrode 2 while being rotated and moved vertically. Particularly, the fourth embodiment can lessen influence of wear of the electrode 2 and make the peripheral surface 2*b* uniform by rotating the electrode 2. Therefore, finishing accuracy of a processed surface by the surface treatment can be heightened.

Then, a voltage is applied between the tool 1 and the electrode 2 by the power source 18 to generate an electric discharge, while the peripheral surface 2*b* of the electrode 2 tracing the helix of the tooth surface of the tool 1 and while the electric discharged part being dipped in the working fluid 10. Thereby, the entire peripheral surface 2*b* of the electrode 2 is evenly used for the machining in order. Thus, it is prevented that the electrode 2 is partially worn, so that the reforming layer 19 can be built uniformly on the peripheral flank 1*a* of the tool 1.

The surface treating electrode 2 may be inclined by the electrode holder 34 by a predetermined angle. In this case, such a predetermined angle of inclination is given to the reforming layer 19 which is built on the peripheral flank 1*a*. Such a predetermined angle can be set by steps S16 and the like of the flowchart of FIGS. 15 and 16, though its detailed description is omitted for avoiding redundancy.

Fifth Embodiment

Figure 19:
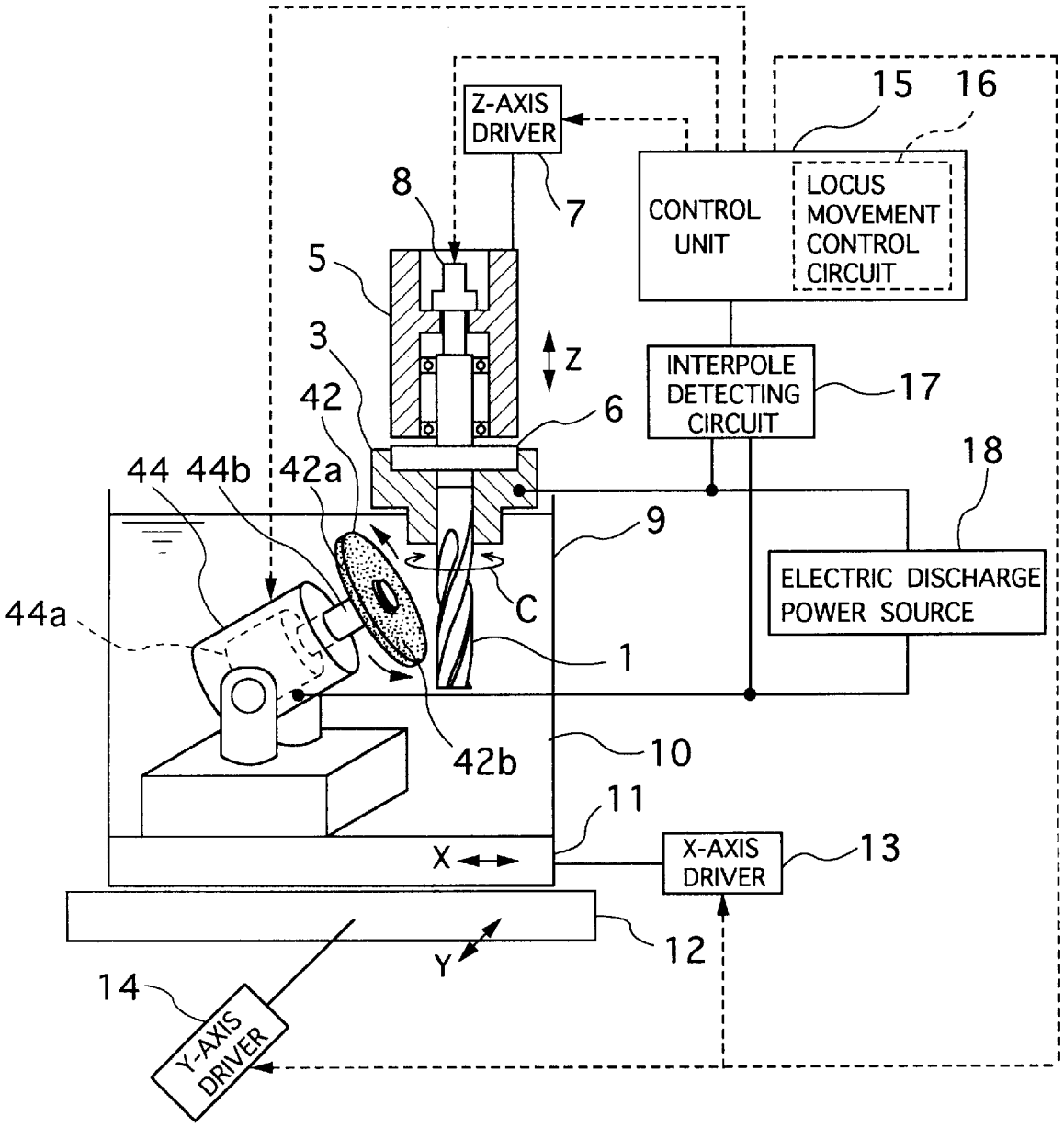
FIG. 19 is a schematic view showing an entire structure of a surface treating apparatus by electric discharge machining according to a fifth embodiment of the invention.

FIG. 19 illustrates an entire structure of a surface treating apparatus by electric discharge machining according to a fifth embodiment of the invention.

As shown in FIG. 19, this embodiment is adapted for use in a surface treatment of a rotating tool such as as an end mill or twist drill with an eccentrically sharpened cutting tooth. The surface treating electrode 42 is formed of a component of a reforming layer, e.g. the same component as that of the first embodiment, into a cylindrical column shape with a small length (compressed cylinder shape), a disc shape or the like. The surface treating electrode 42 is held on an electrode holder 44. The rotating tool 1 is moved in the Z-axis direction while synchronously rotated, under control in the same manner as the first embodiment. The electrode holder 44 is secured at a predetermined position of the X-table 11 as the electrode holder 4 of the first embodiment. Thereby, the position of the electrode 42 is controlled by moving the X-table 11 and Y-table 12 in the X-axis and Y-axis directions via the X-axis driver 13 and Y-axis driver 14 by the control unit 15. Therefore, the tool 1 and the electrode 42 are controllably moved at the same time in one or two or three axis directions of the X-axis, Y-axis and Z-axis directions. The electrode holder 44 accommodates therein a motor 44*a* for rotating the electrode 42, in addition to the same structure as the electrode holder 4 of the first embodiment. Then, the rotation of the motor 44*a* is controlled by the control unit 15. The electrode holder 44 may be made tiltable in a tilting direction (vertically) T like the holder 4 of the first embodiment, so that the flank 1*a* of the tool 1 is inclined to the center axis at a predetermined angle. The surface treating electrode 42 has a discharge surface defined by an outer peripheral surface 42*a* or a circumferential portion 42*b* of a side surface which faces the peripheral flank 1*a* of the cutting tooth of the tool 1. Moreover, the electrode 42 is capable of performing a cutting work such as a mechanical grinding or polishing or the like, by contacting the peripheral surface 42*a* or circumferential portion 42*b* with the tool 1.

FIG. 19 shows a state in which the electrode holder 44 is tilted in the tilting direction T. Thus, it is possible to treat the surface of the cutting edge of the tool 1 which has a flank 1*a* with an eccentric relief sharpening.

The electrode holder 44 as well as the Z-axis driver 7 and rotating shaft holder 8 constitute a relative movement driver for relatively moving the rotating tool 1 and surface treating electrode 42 in the fifth embodiment.

An operation of the surface treating apparatus of the fifth embodiment is described hereafter.

In the fifth embodiment, the rotating tool 1 is rotated with the rotating shaft 6 through the chuck 3 by the rotating shaft driver 8, while being vertically moved with the main shaft 5 by the Z-axis driver 7. At this time, the vertical movement and the rotation of the tool 1 is synchronized by the control of the control unit 15 and locus movement control circuit 16. For the synchronizing operation, the Z-axis moving amount of the main shaft 5 and the rotating amount of the rotating shaft 6 are set so that the peripheral surface 42*a* or the circumferential portion 42*b* as a discharge surface of the electrode 42 moves along the helix of the cutting edge of the tool 1. Such a synchronizing operation of the vertical movement and the rotation of the tool 1 is same as that of the first to fourth embodiments.

The surface treating electrode 42 is mounted on a drive shaft 44*b* and rotated about its center by the motor 44*a* of the holder 44. It is enough to rotate the electrode 42 at a fixed constant speed, contrary to the rotation of the tool 1 to be machined by electric discharge. The rotating speed thereof is preferably one which makes uniform an electric discharge wear of the peripheral surface 42*a* or the like of the electrode 42 and which does not affect the electric discharge. Then, the discharge surface of the electrode 42 is reciprocated over the peripheral flank 1*a* along the helix of the cutting edge, while keeping the same positional relationship with the flank 1*a* of the rotating tool 1 as that of the machining start time. Moreover, in case the electrode 42 has a compressed cylinder shape which is thicker than a disc shape, it is preferable to give such a relative movement as the tool 1 is reciprocated in the axial direction along the electrode 2 while being rotated and moved vertically. In this case, it is possible to make uniform the wear of the discharge surface or the peripheral surface 42*a* of the electrode.

Then, a voltage is applied between the tool 1 and the electrode 42 by the power source 18 to generate an electric discharge, while the peripheral surface 42*a* or the portion 42*b* of the electrode 42 tracing the helix of the tooth surface of the tool 1 and while the electric discharged part being dipped in the working fluid 10. Thereby, the entire peripheral or circumferential part of the electrode 42 of a large diameter disc is used for the machining. Thus, it is prevented that the electrode 42 is partially worn. Moreover, if the electrode 42 is tilted via the electrode holder 44 in the tilting direction T as mentioned above, the reforming layer 19 can be built uniformly on the peripheral flank 1*a* of the tool 1, while keeping its eccentric relief sharpening. Furthermore, the electrode 42 can grind or polish the reforming layer 19, when there is no electric discharge between the electrode 42 and the treated tooth surface, i.e. when the interpole detecting circuit 17 detects their contact. Thereby, the reforming layer 19 is evenly formed on the flank 1*a* of the tool 1 with an eccentric relief sharpening, while the cutting edge is made sharper.

An angle for making the eccentric relief sharpening can be set by Steps S16 and the like of the flowchart of FIGS. 15 and 16, though its detailed description is omitted for avoiding redundancy.

Sixth Embodiment

Figure 20:
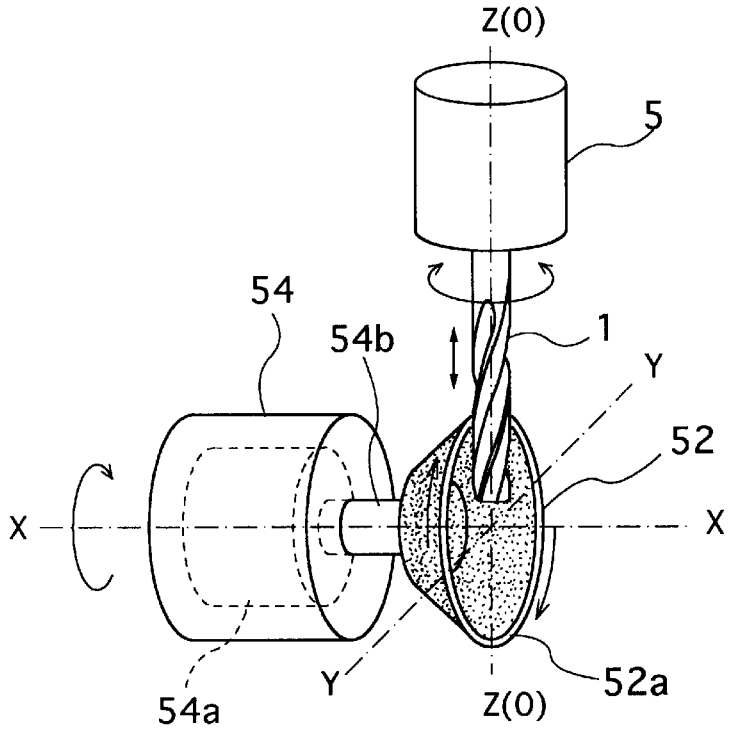
FIG. 20 is a schematic view showing a main portion of a surface treating apparatus by electric discharge machining according to a sixth embodiment of the invention.

FIG. 20 illustrates a main portion of a surface treating apparatus by electric discharge machining according to a sixth embodiment of the invention.

As shown in FIG. 20, a surface treating electrode 52 is formed of a component of a reforming layer, e.g. the same component as that of the first embodiment, into a hollow cone shape of a predetermined thickness with a larger diameter side opened. The surface treating electrode 52 is held on an electrode holder 54. The electrode holder 54 accommodates therein a motor 54*a* for rotating the electrode 52, in addition to the same structure as the electrode holder 4 of the first embodiment. Then, the rotation of the motor 54*a* is controlled by the control unit 15. The electrode holder 54 may be made tiltable in a tilting direction (vertically) T like the holder 4 of the first embodiment, so that the flank 1*a* of the tool 1 is inclined to the center axis at a predetermined angle. The surface treating electrode 52 has a discharge surface defined by a rotating ring surface 52*a* at the open side, which faces the flank 1*a* or the like of the cutting tooth of the tool 1. The electrode 52 is capable of performing a cutting work such as a mechanical grinding or polishing or the like, by contacting the rotating ring surface 52*a* with the tool 1. The rotating tool 1 is moved in the Z-axis direction through the main shaft 5 while rotated through the rotating shaft 6, under control of the control unit 15 and locus movement control circuit 16, in the same manner as the first embodiment. The electrode holder 54 is secured at a predetermined position of the X-table 11 as the electrode holder 4 of the first embodiment, so that the position of the electrode 52 is controlled in the X-axis and Y-axis directions by the control unit 15. Thereby, the tool 1 and electrode 52 are controllably moved at the same time in one or two or three axis directions of the X-axis, Y-axis and Z-axis directions by the control unit 15.

Though not shown in the drawings, the mechanical and electrical structures of this embodiment is basically the same as those of the first embodiment.

The electrode holder 54 as well as the Z-axis driver 7 and rotating shaft driver 8 constitute a relative movement driver for relatively moving the rotating tool 1 and surface treating electrode 52 in the sixth embodiment.

An operation of the surface treating apparatus of the sixth embodiment is described hereafter.

A center of a closed side of the surface treating electrode 52 is fitted to a rotating shaft 54*b* of the electrode holder 54. The electrode 52 performs a surface treating by the rotating ring surface 52*a* along the helix of the cutting edge. The ring surface 52 of the electrode 52 has a diameter larger than the cutting edge length L of the rotating tool 1 so that only one portion of the tool 1 comes near and faces the rotating ring surface 52*a* of the electrode 52. On the other hand, the rotating tool 1 is rotated with the rotating shaft 6 by the rotating shaft driver 8, while being vertically moved with the main shaft 5 by the Z-axis driver 7. At this time, the vertical movement and the rotation of the tool 1 is synchronized by the control of the control unit 15 and locus movement control circuit 16. For the synchronizing operation, the Z-axis moving amount of the main shaft 5 and the rotating amount of the rotating shaft 6 are set so that a discharge surface (facing surface to the cutting edge) of the ring surface 52*a* of the electrode 52 moves along the helix of the cutting edge of the tool 1.

As in the first embodiment, the electrode holder 54 is disposed in the processing vessel 9 filled with the working fluid 10. Then, the interpole detecting circuit 17 and the control unit 15 are used for positioning the electrode 52 and the tool 1 so that the ring surface 52*a* faces the peripheral flank 1*a* and rake face 1*b*. Moreover, the locus movement control circuit 16 synchronizes the Z-axis movement and rotation of the tool 1 on the basis of input informations such as a helical angle θ of the tool 1 to be processed, as in the first embodiment. For example, in case of processing a right-hand helical tooth end mill, the end mill is rotated in the minus direction at a rate of $(360°\times L\times\tan\theta)/(\pi\times D)$ for the moving amount of the main shaft 5 in the minus (upward) direction corresponding to the cutting edge length L, through the locus movement control circuit 16. Thereby, the locus movement control circuit 16 gives such a command to the control unit 15 as the discharge surface (ring surface 52*a*) traces the peripheral flank 1*a*. The control unit 15 controls the moving amount of the X-axis driver 13, Y-axis driver 14 and Z-axis driver 7 and the rotating amount of the rotating shaft driver 8 so as to obtain a desired rotation and relative movement of the tool 1.

Then, an electric discharge is generated between the electrode 52 and the tooth surface to be processed, thereby building the reforming layer 19 on the peripheral flank la of the tool 1. Moreover, when there is no electric discharge between the electrode 52 and the tooth surface, it is possible to grind or polish the reforming layer 19 by the conical electrode 52 of a large diameter. Thus, the reforming layer 19 is built uniformly on the peripheral flank 1*a* of the tool 1 while the cutting edge is made sharp. Namely, the electrode 52 is rotated and contacted with the peripheral flank 1*a* of the tool 1 while the discharge portion is dipped in the working fluid 10. Thereby, the cutting edge is ground or polished by the surface treating electrode 52. In addition, a voltage is applied and electric discharge is generated between the electrode 52 and the processed tooth surface, so that the reforming layer 19 is produced on the peripheral flank 1*a*. Here, the surface treating electrode 52 may be a disc shape or the same shape as a cup grinder other than the conical shape.

Furthermore, the contact angle of the electrode 52 with the peripheral flank 1*a* of the tool 1 may be set appropriately, e.g. in the same manner as the fifth embodiment, so that the reforming layer 19 is built on the cutting edge of the tool with an eccentric relief sharpening while the cutting edge is made sharp. An angle for making the eccentric sharpening can be set by steps S16 and the like of the flowchart of FIGS. 15 and 16, though its detailed description is omitted for avoiding redundancy.

Seventh Embodiment

Figure 21:
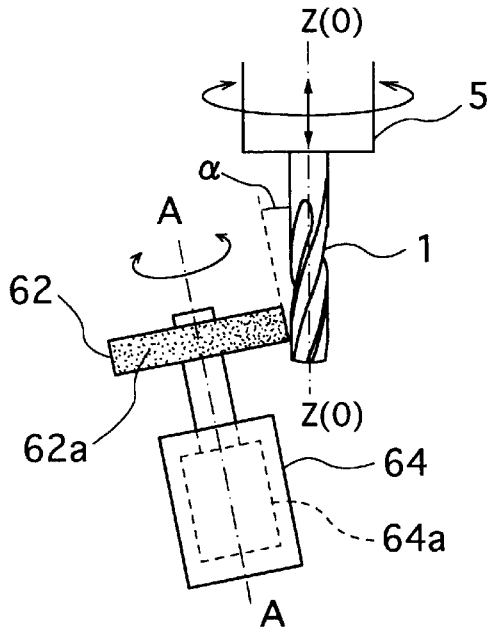
FIG. 21 is a schematic view showing a main portion of a surface treating apparatus by electric discharge machining according to a seventh embodiment of the invention.

FIG. 21 illustrates a main portion of a surface treating apparatus by electric discharge machining according to a seventh embodiment of the invention.

As shown in FIG. 21, this embodiment is adapted for use of a surface treatment of a rotating tool such as an end mill or twist drill, with an eccentrically sharpened tooth, as in the fifth embodiment. A surface treating electrode 62 is formed of a component of a reforming layer, e.g. the same component as that of the first embodiment, into a disc shape with a predetermined thickness. The surface treating electrode 62 is held on an electrode holder 64. The electrode holder 64 accommodates therein a motor 64*a* for rotating the electrode 62, in addition to the same structure as the electrode holder 4 of the first embodiment. Then, the rotation of the motor 64*a* is controlled by the control unit 15. The electrode holder 64 is tiltable in the tilting direction (vertically) T like the holder 4 of the first embodiment, so that the flank 1*a* of the tool 1 can be inclined to the center axis at a predetermined angle. The surface treating electrode 62 has a discharge surface defined by an outer peripheral surface 62*a* which faces the flank 1*a* of the cutting edge of the tool 1. Moreover, the electrode 62 is capable of performing a cutting work such as a mechanical grinding or polishing or the like, by contacting the peripheral surface 62*a* with the tool 1. The rotating tool 1 is moved in the Z-axis direction via the main shaft 5 while rotated via the rotating shaft 6, under control of the control unit 15 and locus movement control circuit 16, in the same manner as the first embodiment. The electrode holder 64 is secured at a predetermined position of the X-table 11 as in the electrode holder 4 of the first embodiment. Thereby, the position of the electrode 62 is controlled in the X-axis and Y-axis directions by the control unit 15. Therefore, the tool 1 and the electrode 62 are controllably moved at the same time in one or two or three axis directions of the X-axis, Y-axis and Z-axis directions. Here, FIG. 21 shows a state in which the center axis of the holder 64 is tilted beforehand in the tilting direction T so as to extend upward while crossing the X-axis direction, since the electrode 62 has the peripheral surface 62*a* defining the discharge surface as well as the grinding or polishing surface. In case of an eccentric flank, such a tilting angle is so set that the axis of the holder 64 and electrode 62 inclines at an angle α for an eccentric relief sharpening to the Z-axis direction. On the other hand, in case of a flank with a flat relief sharpening, it is set such that the axis of the holder 64 and electrode 62 extends in the Z-axis direction.

Though not shown in the drawings, the mechanical and electrical structures of this embodiment is basically the same as those of the first embodiment.

The electrode holder 64 as well as the Z-axis driver 7 and rotating shaft driver 8 constitute a relative movement driver for relatively moving the rotating tool 1 and surface treating electrode 62 in the seventh embodiment.

An operation of the surface treating apparatus of the seventh embodiment is described hereafter.

The rotating tool 1 with an eccentric relief sharpening is mounted on the chuck 3. The surface treating electrode 62 is positioned in relation to the cutting edge of the tool 1 to be treated, e.g. by the process of the flowchart of the second embodiment shown in FIGS. 15 and 16. Moreover, the electrode 62 is set such that its center line A—A is inclined at the angle α to the center line O—O of the tool 1, as shown in FIG. 21. The inclined angle α depends on the diameter D of the tool 1. It is enough to set the angle α into one at which an eccentric relief sharpening is made in a conventional grinding machine. For example, the inclined angle α is set at about 9 degrees if the tool 1 is an end mill with a diameter D of 10 mm. Otherwise, the angle α may be one which is calculated by the expression $(\tan\alpha=\tan\beta\times\tan\theta)$ in the FIG. 21, wherein β is a peripheral relief angle and θ is a helical angle in the tool 1. Then, the electrode 62 machines the cutting edge of the tool by electrical discharge while tracing it, in accordance with the synchronized operation of the relative vertical movement and rotation of the tool 1 in this embodiment. The machining is repeated in accordance with the number of teeth of the rotating tool 1 to be treated. With this process, the reforming layer 19 is built uniformly on the cutting edge of the tool with an eccentric relief sharpening. Such an electric discharge operation may be basically performed by the same process as that of the fourth or sixth embodiment. In the above process, it is preferable to rotate the electrode 62 at a constant speed during the electric discharge machining.

Moreover, even in case of treating the rotating tool 1 with a flat relief sharpening, a tooth thereof can be processed by the surface treatment while changed into a shape with an eccentric relief sharpening. Namely, the electrode 62 is positioned to the cutting edge of the tool 1 in the same manner as the above. Then, the electrode 62 traces the cutting edge of the tool 1 and treats it by electric discharge machining, in accordance with the process for rotating and relatively moving the tool 1 and the electrode 2 in the first, fourth or fifth embodiment, for example. At this time, if the machining is performed at such a discharge energy as the base material, i.e. the cutting edge of the tool 1 is removed in machining, the reforming layer 19 is built on the processed tooth surface, while the flank 1*a* of the rotating tool 1 is changed from a flat shape to an eccentric shape. This process is repeated according to the number of teeth of the tool 1 to be treated. At this time, an angle for making the eccentric sharpening can be set by Steps S16 and the like of the flowchart of FIGS. 15 and 16, though its detailed description is omitted for avoiding redundancy.

Eighth Embodiment

Figure 22:
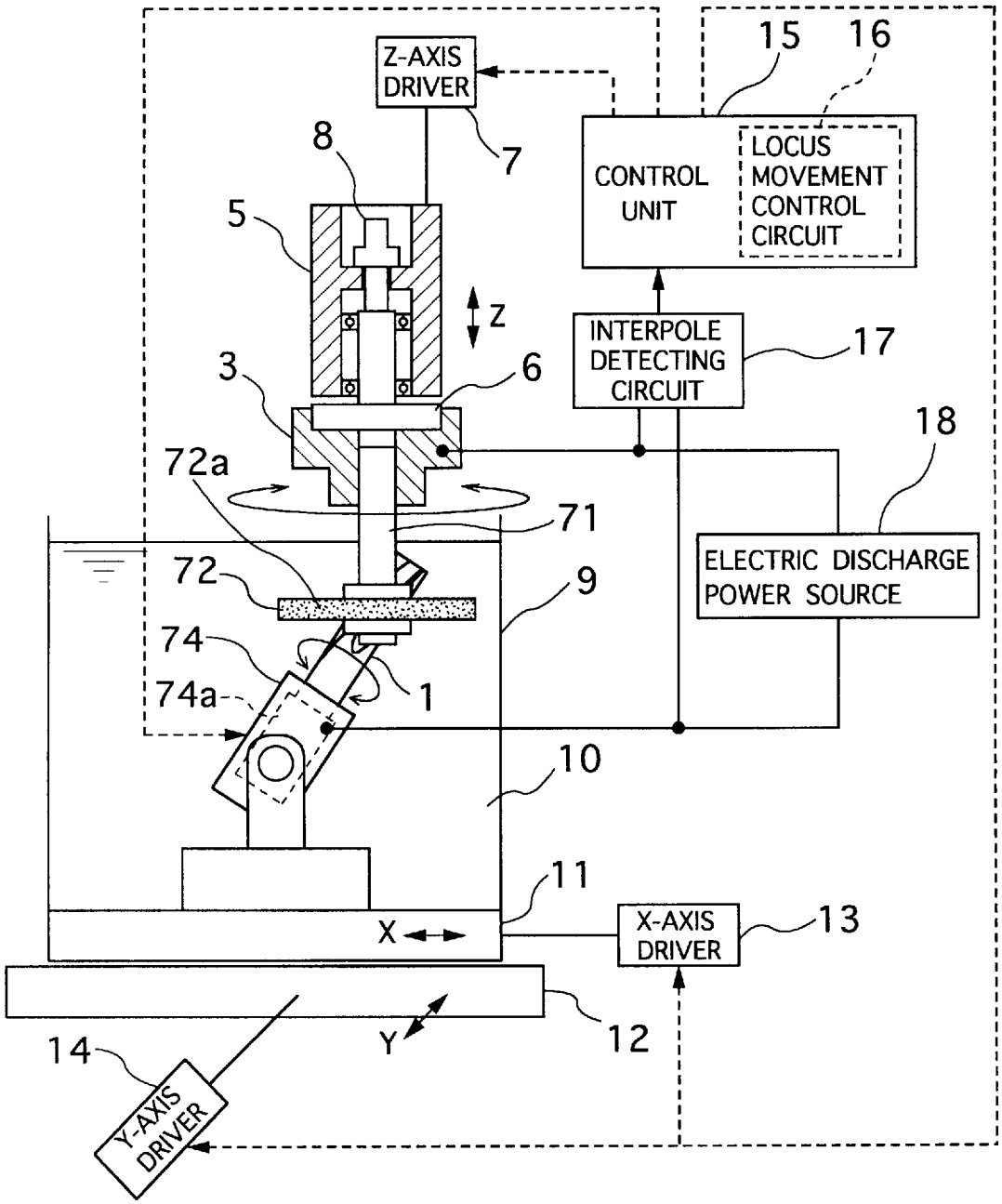
FIG. 22 is a schematic view showing an entire structure of a surface treating apparatus by electric discharge machining according to an eighth embodiment of the invention.

FIG. 22 illustrates an entire structure of a surface treating apparatus by electric discharge machining according to an eighth embodiment of the invention.

Basically, the present embodiment apparatus has a reverse positional relationship of the rotating tool 1 and a surface treating electrode 72 in the seventh embodiment, as shown in FIG. 22. Namely, this embodiment is adapted for use of a surface treatment of a rotating tool such as as an end mill or twist drill, with an eccentrically sharpened tooth, as in the fifth embodiment. The surface treating electrode 72 is formed of a component of a reforming layer, e.g. the same component as that of the first embodiment, into a disc shape with a predetermined thickness. The rotating tool 1 is held on an electrode holder 74. The electrode holder 74 accommodates therein a motor 74*a* for rotating the tool 1, in addition to the same structure as the electrode holder 4 of the first embodiment. Then, the rotation of the motor 74*a* is controlled by the control unit 15. The electrode holder 74 is tiltable in a tilting direction (vertically) T like the holder 4 of the first embodiment, so that the flank 1*a* of the tool 1 can be inclined to the center axis at a predetermined angle. The surface treating electrode 72 has a discharge surface defined by an outer peripheral surface 72*a* which faces the peripheral flank 1*a* of the tool 1. Moreover, the electrode 72 is capable of performing a cutting work such as a mechanical grinding or polishing or the like, by contacting the peripheral surface 72*a* with the tool 1. The electrode 72 is held on the chuck 3 via a connecting shaft 71 and rotated through the rotating shaft 6 by the rotating shaft driver 8. Moreover, the electrode 72 is moved in the Z-axis direction via the main shaft 5 by the Z-axis driver 7, while its position is controlled by the control unit 15, in the same manner as the first embodiment.

On the other hand, the rotating tool 1 is coaxially supported on the electrode holder 74. The holder 74 is secured at a predetermined position of the X-table 11, so that the tool 1 is moved in the X-axis and Y-axis directions through the X-table 11 and Y-table 12 by the X-axis driver 13 and Y-axis driver 14, while its position is controlled by the control unit 15. The holder 74 is disposed such that its axis extends parallel to the X-table 11, as a standard position, so that the axis of the tool 1 extends parallel to the X-table in the X-axis direction.

Therefore, the tool 1 and the electrode 72 are relatively moved at the same time in one or two or three axis directions of the X-axis, Y-axis and Z-axis directions.

The electrode holder 74 including the motor 74*a* and the Z-axis driver 7 constitute a relative movement driver for relatively moving the rotating tool 1 and surface treating electrode 72 in the eighth embodiment.

An operation of the surface treating apparatus of the eighth embodiment is described hereafter.

The surface treating electrode 72 is mounted on the chuck 3 via the connecting shaft 71. The rotating tool 1 with an eccentric relief sharpening is mounted on the electrode holder 74. The surface treating electrode 72 is positioned in relation to a treated surface of the cutting edge of the tool 1 by the interpole detecting circuit 17 and control unit 15. At this time, the tool 1 is set such that its center line O—O (see FIG. 21) is inclined at a predetermined angle to the center line A—A (see FIG. 21) of the electrode 72. The inclined angle is set in the same manner as the seventh embodiment and depends on the diameter D of the tool 1. Otherwise, the inclined angle may be one which is calculated by the expression ($\tan \alpha = \tan \beta \times \tan \theta$) as in the seventh embodiment, wherein $\beta$ is a peripheral relief angle and $\theta$ is a helical angle in the tool 1. Then, the peripheral surface 72*a* of the electrode 72 machines the cutting edge of the tool 1 by electrical discharge while tracing it, in accordance with the operation of the relative vertical movement and rotation of the tool 1 in the first, second or third embodiment, for example. The machining is repeated in accordance with the number of teeth of the rotating tool 1 to be treated. With this process, the reforming layer 19 is built uniformly on the cutting edge of the tool 1 with an eccentric relief sharpening.

Moreover, even in case of treating the rotating tool 1 with a flat relief sharpening, a tooth thereof can be processed by the surface treatment while changed into a shape with an eccentric relief sharpening as in the seventh embodiment. Namely, the electrode 72 is positioned to the cutting edge of the rotating tool 1 in the same manner as the above. Then, the electrode 72 traces the cutting edge of the tool 1 and treats it by electric discharge machining, in accordance with the above process for rotating and relatively moving the tool 1 and the electrode 72. At this time, if the machining is performed at such a discharge energy as the base material, i.e. the cutting edge of the tool 1 is removed in machining, the reforming layer 19 is built on the processed tooth surface, while the flank 1*a* of the rotating tool 1 is changed from a flat shape to an eccentric shape. This process is repeated according to the number of teeth of the tool 1 to be treated. At this time, an angle for making the eccentric sharpening can be set by steps S16 and the like of the flowchart of FIGS. 15 and 16, though its detailed description is omitted for avoiding redundancy.

Ninth Embodiment

Figure 23:
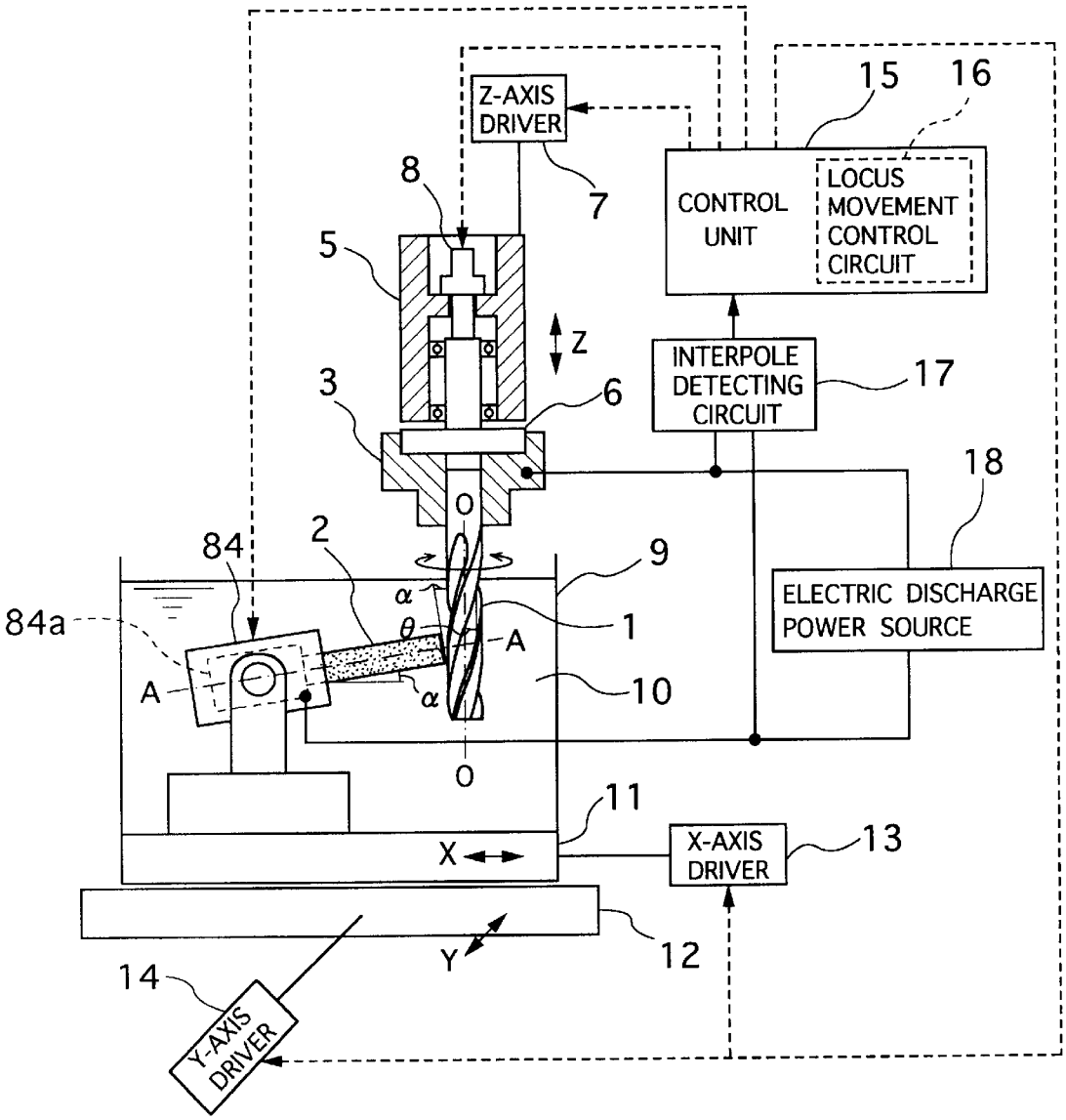
FIG. 23 is a schematic view showing an entire structure of a surface treating apparatus by electric discharge machining according to a ninth embodiment of the invention.

FIG. 23 illustrates an entire structure of a surface treating apparatus by electric discharge machining according to a ninth embodiment of the invention.

As shown in FIG. 23, this embodiment is adapted for use of a surface treatment of a rotating tool such as as an end mill or twist drill, with an eccentrically sharpened tooth, as in the fifth, seventh or eighth embodiment. Moreover, the present embodiment apparatus has a structure similar to that of the first embodiment apparatus. Namely, a surface treating electrode 82 has a similar structure as the electrode 2 of the first embodiment, while formed of a component of a reforming layer into a round column shape of a predetermined length. The surface treating electrode 82 is held on an electrode holder 84. The electrode holder 84 is secured on the X-table 11 in the same way as the electrode holder 4 of the first embodiment. Thereby, the tool 1 and the electrode 82 are relatively moved at the same time in one or two or three axis directions of the X-axis, Y-axis and Z-axis directions, in the same manner as the first embodiment. The electrode holder 84 accommodates therein a motor 84*a* for rotating the electrode 82, as in the electrode holder 44 of the fifth embodiment or the like. The electrode holder 84 is tiltable in the tilting direction (vertically) T like the holder 4 of the first embodiment, so that the flank 1*a* of the tool 1 can be inclined to the center axis at a predetermined angle. The surface treating electrode 82 has a discharge surface defined by an end surface 82*a* which faces the flank 1*a* or the like of the tool 1, as in the first embodiment. Moreover, the electrode 82 is capable of performing a cutting work such as a mechanical grinding or polishing or the like, by contacting the end surface 82*a* with the tool 1.

The electrode holder 84 as well as the Z-axis driver 7 and rotating shaft driver 8 constitute a relative movement driver for relatively moving the rotating tool 1 and surface treating electrode 82 in the ninth embodiment.

An operation of the surface treating apparatus of the seventh embodiment is described hereafter.

The surface treating electrode 82 is mounted on the electrode holder 84. The rotating tool 1 with an eccentric relief sharpening is mounted on the chuck 3. The surface treating electrode 82 is slanted at an inclined angle $\alpha$. Namely, the electrode 82 is set such that its center line A—A is inclined at the angle $\alpha$ to the center line O—O of the tool 1, as shown in FIG. 23. Next, the electrode 83 is positioned to the cutting edge of the tool 1 to be treated, e.g. based on the same process as that of the second embodiment (see FIGS. 15 and 16). The inclined angle $\alpha$ of the electrode 82 depends on the diameter D of the tool 1. It is enough to set the angle $\alpha$ into one at which an eccentric relief sharpening is made in a conventional grinding machine. For example, the inclined angle $\alpha$ is set at about 9 degrees if the tool 1 is an end mill with a diameter D of 10 mm. Otherwise, the angle $\alpha$ may be one which is calculated by the expression ($\tan\alpha=\tan\beta\times\tan\theta$) in the FIG. 23, wherein $\beta$ is a peripheral relief angle and $\theta$ is a helical angle in the tool 1. Then, the electrode 82 machines the cutting edge of the tool 1 by electrical discharge while tracing it, in accordance with the synchronized operation of the relative vertical movement and rotation of the tool 1, which is performed similarly to the first embodiment. The machining is repeated in accordance with the number of teeth of the rotating tool 1 to be treated. With this process, the reforming layer 19 is built uniformly on the cutting edge of the tool with an eccentric relief sharpening.

Moreover, even in case of treating the rotating tool 1 with a flat relief sharpening, a tooth thereof can be processed by the surface treatment while changed into a shape with an eccentric relief sharpening. Namely, the end surface 82*a* of the electrode 82 is positioned to the cutting edge of the rotating tool 1 in the same manner as the above. Then, the electrode 82 traces the cutting edge of the tool 1 and treats it by electric discharge machining, in accordance with the above process for rotating and relatively moving the tool 1 and the electrode 82. At this time, if the machining is performed at such a discharge energy as the base material, i.e. the cutting edge of the tool 1 is removed in machining, the reforming layer 19 is built on the processed tooth surface, while the flank 1*a* of the rotating tool 1 is changed from a flat shape to an eccentric shape. This process is repeated according to the number of teeth of the tool 1 to be treated. At this time, an angle $\alpha$ for making the eccentric sharpening can be set by steps S16 and the like of the flowchart of FIGS. 15 and 16, though its detailed description is omitted for avoiding redundancy.

Tenth Embodiment

Figure 24:
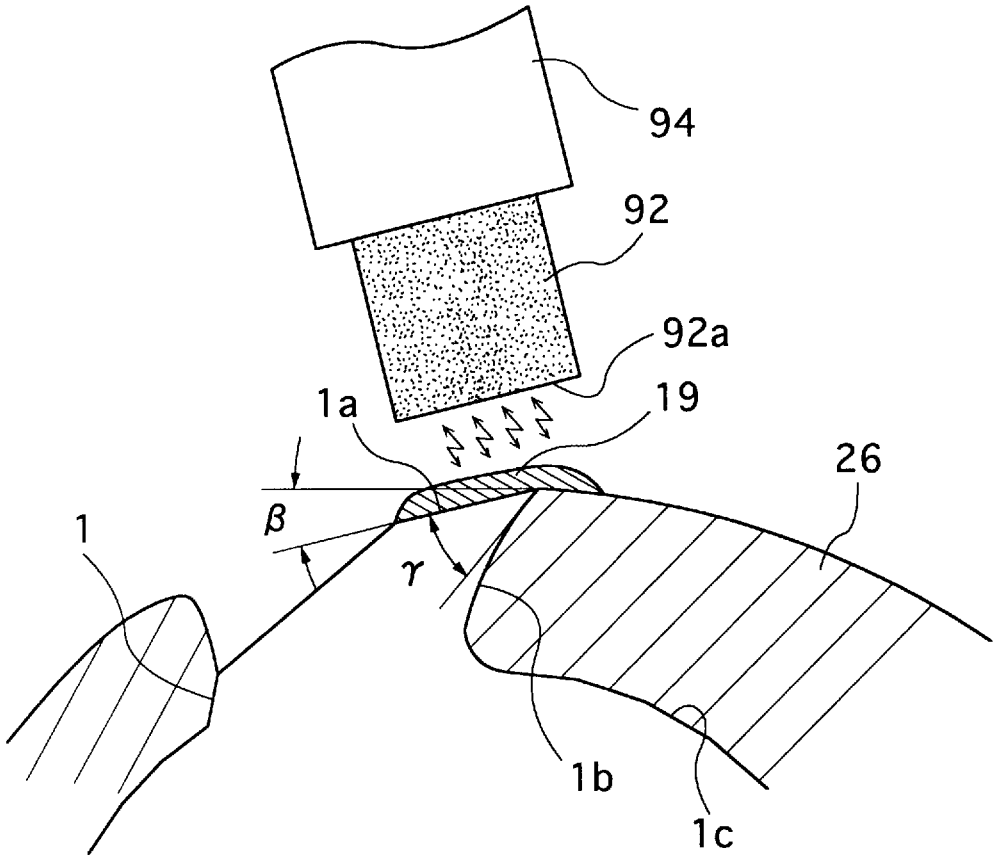
FIG. 24 is a schematic view showing a main portion of a surface treating apparatus by electric discharge machining according to a tenth embodiment of the invention.
Figure 25:
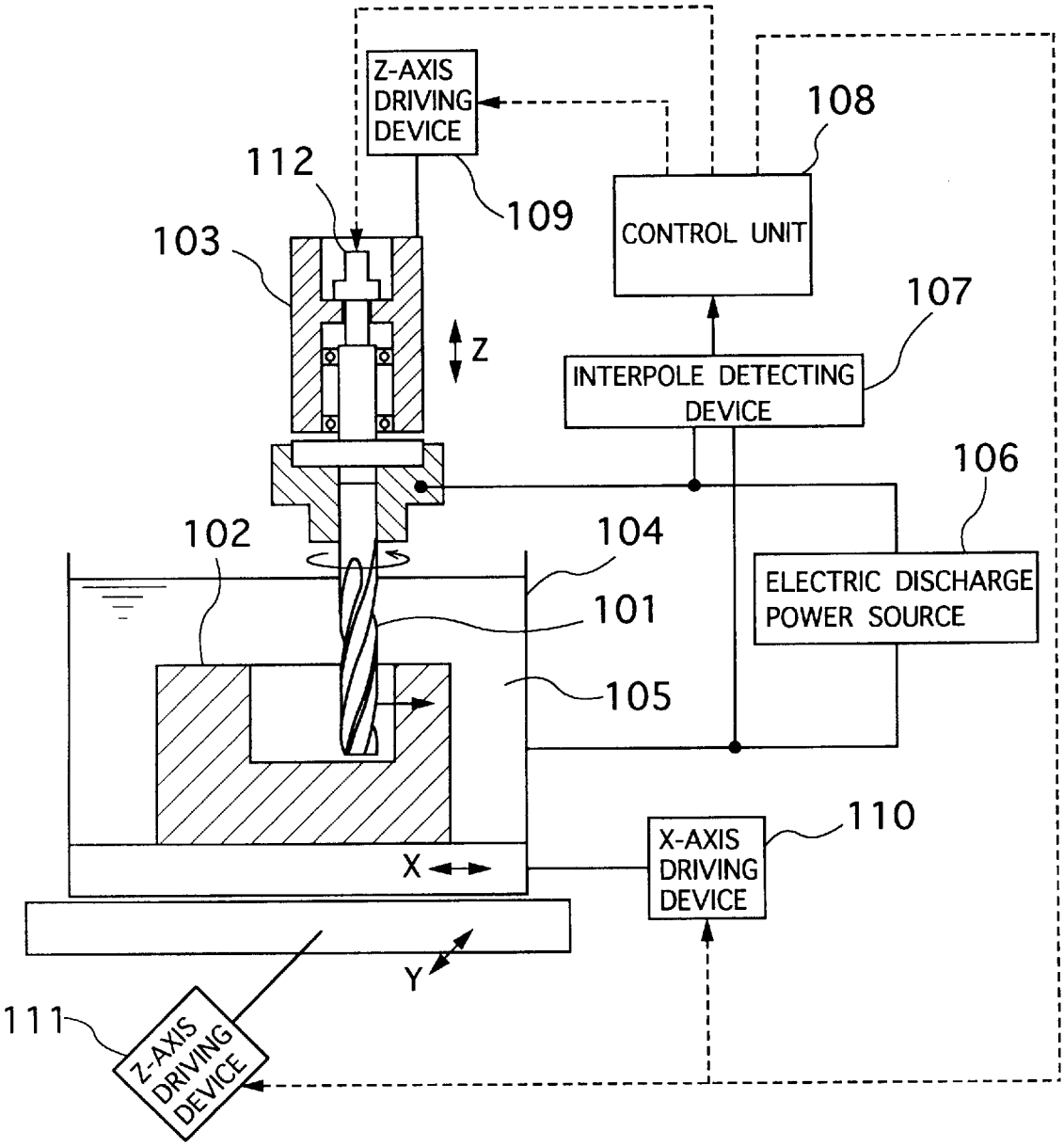
FIG.25 (PRIOR ART)
FIG. 25 is a schematic view showing an entire structure of a surface treating apparatus in the related art.

FIG. 24 illustrates a main portion of a surface treating apparatus by electric discharge machining according to a tenth embodiment of the invention.

As shown in FIG. 24, a surface treating electrode 92 is formed of a component of a reforming layer, e.g. the same component as the electrode 2 or the like of the first embodiment, into a round column shape with a predetermined length. The electrode 92 is held on the electrode holder 94. The tool 1 and the electrode 92 are relatively moved at the same time in one or two or three axis directions of the X-axis, Y-axis and Z-axis directions, in the same manner as the first embodiment. An auxiliary member 26 has a protrusion corresponding to the shape of the helical flute 1*c* of the tool 1 such as an end mill or twist drill to be processed. The auxiliary member 26 is fitted into the flute 1*c* while being closely contacted with the rake face 1*b* of the tooth of the tool 1. The auxiliary members 26 are prepared for the number of the helical flutes 1*c* of the tool 1 and fitted in the flutes 1*c*, respectively. If the rotating tool 1 has no helix and the flute has a linear or straight plan shape, the auxiliary member 26 has a protrusion of a straight plan shape so as to be fitted into the straight flute while contacted closely with the rake face 1*b*. The auxiliary member 26 defines a surface continuous to the cutting edge flank 1*a* when fitted in the flute 1*c* of the tool 1.

Though not shown in detail, the mechanical and electrical structures of this embodiment are basically the same as those of the first embodiment.

An operation of the surface treating apparatus of the tenth embodiment is described hereafter.

First, the rotating tool 1 is mounted on the chuck 3 of the first embodiment. Then, the auxiliary member 26 is fitted into the flute 1*c*, so that the outer peripheral surface of the auxiliary member 26 defines a continuous surface to the flank 1*a* of the tool 1. Thereafter, the tool 1 and auxiliary member 26 held on the chuck 3 are rotated with the rotating shaft 6 by the rotating shaft driver 8, while moved vertically with the main shaft 5 by the Z-axis driver 7. At this time, the vertical movement and rotation are synchronized as in each above embodiment. Namely, the vertical moving amount and the rotating amount are set such that a discharge surface of the electrode 92 moves along the helix of the helical angle $\theta$ of the tool 1 to be machined by the electrical discharge.

Then, an end surface 92*a* as the discharge surface of the electrode 92 is moved on the peripheral flank 1*a* along the helix of the cutting edge, while keeping its positional relationship with the flank 1*a* at a start time of processing. Here, the electrode 92 is positioned to the tool 1 such that the end surface 92*a* faces the flank 1*a* while going beyond the cutting edge thereof.

Then, the power source 18 applies a voltage to generate an electrical discharge between the tool 1 and electrode 92, while the electrode 92 traces the processed tooth surface and while the discharge portion is dipped in the working fluid 10. Thus, the reforming layer is built on the peripheral flank 1*a* of the tool 1. At this time, as shown in FIG. 24, the auxiliary member 26 is contacted closely to the rake face 1*b* so as to be flush with the peripheral flank 1*a*. Therefore, when the auxiliary member 26 is removed after forming the reforming layer 19 by the electric discharge generated between the end surface 92*a* of the electrode 92 and the tooth surface, the cutting edge is prevented from getting dull by the electric discharge. Simultaneously, the reforming layer 19 can be built completely up to the cutting edge of the flank 1*a* of the tool 1. Moreover, the rake face 1*b* is formed with the reforming layer 19 by the thickness thereof, too.

Furthermore, even if the discharge surface of the electrode 92 goes beyond the cutting edge, the auxiliary member 26 lessens electrical discharge concentration on the cutting edge portion of the tool 1, thereby eliminating influences thereof, e.g. restraining the cutting edge from getting dull.

While the relative movement driver of each above embodiment comprises the rotating shaft driver 8, the Z-axis driver 7 or the like, in order to relatively move the rotating shaft 1 and the surface treating electrode, any modification is possible as long as it can control the relative movement of the rotating tool 1 and the electrode holder for supporting the electrode so that the discharge surface of the electrode traces the treated surface of the cutting edge of the tool 1.

In the surface treating apparatus of each above embodiment, the cutting edge of the rotating tool 1 and the g surface treating electrode are relatively moved while keeping a relation $(360°\times L\times\tan\theta)/(\pi\times D)$ between the rotation and the feed of the cutting edge length in the axial direction of the tool 1, when the tool 1 has a helical angle $\theta$, cutting edge length L for forming the reforming layer 19 and diameter D. However, it is possible that the electric discharge machining is performed only when the peripheral flank 1*a* of the tool 1 faces the electrode, while the rotating speed is made faster than the moving speed in the axial direction of the tool 1. Moreover, the periphery of the tool 1 may be repeatedly moved in parallel in the longitudinal direction in performing the electric discharge machining.

Namely, each above embodiment of surface treating apparatus by electric discharge machining builds the reforming layer 19 on the cutting edge of the rotating tool 1 by the surface treating electrode 2, 42, 52, 62, 72, 82, 92 composed of a reforming material. It can be embodied into a structure with the following features. That is, the surface treating electrode composed of the reforming material builds the reforming layer 19 on the cutting edge of the rotating tool 1 by the electric discharge for the tool 1. The relative movement driver rotates the tool 1 and relatively moves the tool 1 and electrode so as to make them face to each other. The relative movement driver may be formed in several ways, e.g. by one of the following combinations: the rotating shaft driver 8 and Z-axis driver 7; the electrode holder 24, X-axis driver 13 and Y-axis driver 14; the Z-axis driver 7 and rotating shaft driver 8 with the electrode holder 34, X-axis driver 13 and Y-axis driver 14; the electrode holder 44 and Z-axis driver 7 and rotating shaft driver 8; the electrode holder 54 and Z-axis driver 7 and rotating shaft driver 8; the electrode holder 64 and Z-axis driver 7 and rotating shaft driver 8; the electrode holder 74 and Z-axis driver 7 and rotating shaft driver 8; the electrode holder 84 and Z-axis driver 7 and rotating shaft driver 8. The electric discharge power source 18 applies voltage between the cutting edge of the tool 1 and the electrode.

With the above structure, the following surface treating method by electric discharge machining can be adopted for building the reforming layer 19 on the cutting edge of the tool 1 by the electrode. In the method, the electrode is opposed to the tool 1 along the cutting edge, while the electric discharge is generated between the tool 1 and the electrode, thereby making up the reforming layer 19 on the cutting edge of the tool 1.

Accordingly, if the tool 1 is rotated while the surface treating electrode is moved relative to the tool 1 so as to face the cutting edge thereof by the relative movement driver composed of, e.g. the rotating shaft driver 8 and Z-axis driver 7 and while the voltage is applied to generate the electric discharge between the tool 1 and the electrode by the power source 18, the reforming layer 19 can be produced on the peripheral flank 1*a* and rake face 1*b* of the tool 1. Thereby, the reforming layer 19 can be built uniformly on the cutting edge of the tool 1, so that the tool life can be highly prolonged and the sharpness of the cutting edge can be improved.

Moreover, each above embodiment of surface treating apparatus by electric discharge may be embodied into a structure which has the following features in addition to the above features. Namely, the relative movement driver is constituted by the rotating shaft driver 8 and Z-axis driver 7 for rotating the tool 1 while moving the electrode relative to the tool 1 so as to face the cutting edge thereof. The power source 18 applies voltage between the cutting edge of the tool 1 and the electrode. The interpole detecting circuit 17 detects the interpole voltage between the tool 1 and the electrode. The control unit 17 controls the electric discharge generated between the cutting edge of the tool 1 and the electrode on the basis of the output from the interpole circuit 17.

With the above structure, the following method can be adopted in which a specific control is carried out. Namely, the relative position of the electrode to the cutting edge of the tooth of the tool 1 is detected. Then, that position is corrected on the basis of a correcting information composed of at least one of the peripheral relief angle $\beta$ and rake angle $\gamma$ of the tool 1 as well as the diameter D of the electrode, so that the positions of the tool 1 and the electrode are determined. Thereafter, the tool 1 and the electrode are relatively moved, while the electrode is faced to the tool 1 along the cutting edge. Simultaneously, the electric discharge is generated between the tool 1 and electrode, thereby making up the reforming layer 19 on the cutting edge of the tool 1.

More in detail, the cutting edge of the tool 1 to be processed is positioned to the electrode, for a start, which is formed of a surface treatment material into a simple shape such as a round column or square column. Then, the contacting state of the processed cutting edge and the electrode is detected so as to identify the positional relationship between the processed surface of the cutting edge and the discharge surface of the electrode. Thereafter, their positions are automatically corrected so that the processed surface of the cutting edge and the discharge surface of the electrode become a predetermined positional relationship. Next, the electrode traces the tooth surface of the helical or straight cutting edge, while making the electric discharge machining surface move at a constant speed. Thus, the reforming layer 19 is built on the whole length of the cutting edge of the tool 1.

Accordingly, the reforming layer 19 can be produced on the peripheral flank 1*a* and rake face 1*b* of the tool 1. Particularly, the control unit 15 controls the electric discharge generated between the cutting edge of the tool 1 and the electrode. Therefore, it is possible to attain a stable electric discharge and make even the reforming layer 19 formed on the flank 1*a* and rake face 1*b* of the tool 1.

Specifically, in the third to ninth embodiments, the surface treating electrode 42, 52, 62, 72 is a disc shape or conical shape. The relative position is detected between the electrode and the cutting edge of the tool 1. The position is corrected on the basis of the correcting information composed of at least one of the peripheral relief angle β and rake angle γ of the tool 1 as well as the diameter d of the electrode, so that the positions of the tool 1 and the electrode are determined. Then, the electrode of the disc shape or the like is rotated and moved relative to the tool 1 along the cutting edge thereof while being opposed thereto. Simultaneously, the electric discharge is generated between the tool 1 and the electrode, thereby constituting the reforming layer 19 on the cutting edge of the tool 1. At the same time, the cutting edge of the tool 1 is sharpened by the cutting work using the electrode.

Accordingly, it is possible to automatically set the best position for the electric discharge machining between the electrode and the tool 1. Moreover, the voltage is applied to generate the electric discharge between the tool 1 and the electrode, so that the reforming layer 19 can be produced on the cutting edge of the tool 1. In addition, the reforming layer 19 can be built uniformly on the cutting edge of the tool 1, and the tool life can be highly prolonged. Furthermore, it is possible to make the cutting edge sharp by further cutting the reforming layer 19 by the electrode.

Each above embodiment fixes one of the tool 1 and electrode while moving the other of them, so that a conventional die sinking electric discharge machine can be used as it is. Moreover, since the discharge surface of the electrode machines the peripheral flank 1*a* of a straight or helical shape of the tool 1, while tracing the cutting edge, by the rotating and vertically moving operation of the tool 1, the processing mechanism can be simplified.

Furthermore, the relative positions or positional relationship of the electrode and the tool 1 are determined by detecting the contact of the electrode with the cutting edge of the tool 1 so that they are placed at predetermined positions. Therefore, even if another type of surface treating electrode or rotating tool is used, the inventive apparatus can cope with such a change. In addition, after the above relative position detecting operation, the positions of the electrode and tool 1 are corrected to a predetermined positions. Therefore, there is no unintened variation in setting the positions, and the results in the processing can be restrained from varying.

In the fourth to ninth embodiments, in the above structures, the angle α between the discharge surface of the electrode and the peripheral flank 1*a* of the tool 1 equals to an angle at which an eccentric relief sharpening is made on the peripheral flank 1*a* of the rotating tool 1. Then, an electric discharge is generated between the tool 1 with an eccentric relief sharpening and the surface treating electrode, while the electrode is moved relative to the tool 1 along the cutting edge thereof. Thereby, the reforming layer 19 is built on the eccentrically sharpened peripheral flank 1*a* of the tool 1.

Accordingly, the reforming layer 19 can be formed on the cutting edge of the tool 1 by applying voltage and generating the electric discharge between the tool 1 with the eccentric relief sharpening and the electrode. Thus, it is possible to reform the treated surface corresponding to the property of the rotating tool 1 only with the electric discharge machining. Moreover, the reforming layer 19 is formed uniformly on the cutting edge of the tool 1 so as to drastically prolong the tool life as well as improve the sharpness of the cutting edge.

In the fourth to ninth embodiments, in the above method, the electric discharge machining is carried out at such a discharge energy as to machine even the base material of the rotating tool 1. Thereby, the reforming layer 19 is made up on the peripheral flank 1*a* of the tool 1 and the flank 1*a* is eccentrically sharpened at once.

Accordingly, the shape of the peripheral flank 1*a* can be changed from a flat one to an eccentric one without use of a mechanical grinding machine, particularly by performing the electric discharge machining under a prescribed electric condition, i.e. at the discharge energy to machine the base material of the tool 1. Thereby, it is possible to reduce costs for regrinding or the like.

In the tenth embodiment, in the above structure, the auxiliary member 26 is fitted into the flute 1*c* of the rotating tool 1 while contacted closely to the rake face 1*b*, thereby defining a continuous surface to the peripheral flank 1*a*. Then, an electric discharge is generated between the cutting edge of the tool 1 with the auxiliary member 26 and the surface treating electrode 92 of the reforming material, while the electrode 92 is relatively moved along the cutting edge of the tool 1, thereby constituting the reforming layer 19 on the peripheral flank 1*a*. Then, the auxiliary member 26 is removed. Accordingly, the cutting edge is prevented from getting dull due to the electric discharge by making the auxiliary member 26 touch the cutting edge to be treated. Thereby, the tool life can be prolonged without deterioration of sharpness of the rotating tool 1 to be processed.

In each above embodiment, the cutting edge of the rotating tool 1 and the surface treating electrode are relatively moved while keeping a relation $(360° \times L \times \tan\theta)/(\pi \times D)$ between the rotation and the feed in the cutting edge length in the axial direction of the tool 1, when the tool 1 has a helical angle θ, cutting edge length L for forming the reforming layer 19 and diameter D.

Therefore, the relative locus of the treated surface of the tool 1 and the electrode is obtained by the helical angle θ, cutting edge length L, diameter D and helical direction of the tooth, so that such a locus can be easily generated. Moreover, the electrode and the treated surface of the tool 1 relatively move at a constant speed, thereby decreasing fluctuation of the electric discharge machining state for the treated surface. Thus, it is possible to make uniform the thickness, surface roughness or the like of the reforming layer 19 produced on the flank 1*a* of the tool 1. Furthermore, since the helical angle θ, cutting edge length L and the like of the treated tool 1 are used for data for generating the locus, so that the rotating tool 1 without helical cutting edge can be processed.

The surface treating electrode 2 of the first to third embodiments is secured at a specified angle so as to face the cutting edge. Therefore, the mechanism for securing the electrode 2 can be most simplified.

The surface treating apparatus according to the fourth to ninth embodiments can make the surface treating electrode face the cutting edge of the rotating tool 1 and set the inclined angle α. Therefore, the set angle of the electrode to the treated cutting edge of the tool 1 can be freely selected. Thus, it is possible to cope with the rotating tool 1 which has the peripheral flank 1*a* formed by a flat relief sharpening or an eccentric relief sharpening.

The surface treating apparatus of the fourth to ninth embodiments rotate the surface treating electrode so as to lessen influences of wear of the electrode due to the electric discharge machining. Moreover, the periphery of the electrode can be made even and its finishing accuracy can be improved. Moreover, the mechanical grinding or eccentric relief sharpening is possible. Furthermore, it is possible to lessen scattering in the electric discharge machining for the treated surface and make uniform the thickness, roughness or the like of the reforming layer 19 built on the peripheral flank of the tool 1.

In the above embodiments, it is important to control the relative movement speed (feeding speed) of the rotating cutting tool 1 in order to maintain the sequential processes of the cutting (grinding, polishing or the like) and the electric discharge successively performed thereafter. Namely, a normal electric discharge machining makes a control to draw back an electrode moving locus at the time of generation of a short circuit or the like, such an operation being called "a short circuit backing". However, in the inventive surface treatment by such an electric discharge machining, the short circuit disappears by the cutting operation, so that it is unnecessary to frequently perform the short circuit backing. To the contrary, if the electrode is drawn back too many times, the machining is mainly composed of the electric discharge machining. In this case, it is possible that a density of the reforming material produced by the cutting work decreases between the electrodes, so that the surface reforming effects are deteriorated. That is, in the inventive surface treatment by electric discharge machining, it is preferable to control a proportion of the electrode backing operation or the speed of the electrode feed so that the cutting and the electric discharge machining are performed at an appropriate proportion. For that reason, the interpole detecting circuit 17 detects the interpole voltage between the electrodes, calculates an average voltage and determines an amount corresponding to an electric discharge frequency, i.e. an electric discharge machining amount based on the average voltage. The control unit 15 calculates a proportion between the electric discharge machining and the cutting on the basis of the above results and a present tool feed speed. Then, the control unit 15 controls and changes the tool feed speed so that the proportion is kept at an appropriate value. Moreover, the control unit 15 can change the thickness of the reforming layer 19 by changing the tool feed speed and the proportion between the cutting and the electric discharge machining. Namely, it is possible to finish the reforming layer in a thin and uniform one by decreasing the feed speed as a final finishing process.

The stability of the electric discharge is affected by the rotating speed of the tool 1. Accordingly, if the rotating speed is too high, a discharge point between the electrodes fluctuates in an electric discharge pulse duration. Thereby, it becomes difficult to maintain a discharge arc, so that a discharge efficiency is lowered. Namely, if the rotating speed is high, the cutting efficiency increases, however, the discharge efficiency decreases and the cutting proportion augments. On the other hand, if the rotating speed is low, the cutting efficiency is lowered, contrary to the above, and the discharge efficiency becomes high. Therefore, it is possible to use the rotating speed for varying the rate between the electric discharge machining and the cutting. Even if the rotating speed is same, a circumferential speed is different according to the tool diameter. Thus, it is preferable to control the rotating speed in an appropriate one according to the tool diameter.

In each above embodiment, it is not always necessary to dip the surface treating electrode set inside the processing vessel 9 and the treated portion of the rotating tool 1 in the working fluid 10. Otherwise, it is possible to build the reforming layer 19 on the peripheral flank la and rake face 1*b* of the tool 1 by the above electric discharge machining method, while spraying the working fluid 10 on a discharged portion.

In the above embodiments, the electrode holder 4, 34, 44, 54, 64, 84, 94 or the chuck 3 constitutes securing means for securing the surface treating electrode 2, 42, 52, 62, 72, 92 at such a specific angle as to face the tooth of the rotating tool 1. Moreover, the electrode holder 4, 34, 44, 54, 64, 84, 94 or a chuck 3 constitutes mounting means for mounting the surface treating electrode 2, 42, 52, 62, 72, 92 opposite to the tooth of the tool 1, the mounting means being capable of setting and changing a facing angle of the surface treating electrode to the tooth. Furthermore, the motor 4*a*, 34*a*, 44*a*, 54*a*, 64*a*, 84*a* or a rotating shaft driver 8 constitutes rotating means for rotating the surface treating electrode 2, 42, 52, 62, 72, 92.

In addition, in the fifth to ninth embodiments, the surface treating electrode may have any rotating body shape other than the disc or conical shape, as long as it can perform a desired electric discharge machining as well as cutting work in the same manner as the above.

In the second to tenth embodiments, the electrode is preferably moved in the axial or radial direction via the X, Y or Z-axis driver under control of the control unit so that the wear due to the electric discharge is compensated, as stated in the first embodiment.

The preferred embodiments described herein are illustrative and not restrictive, the scope of the invention being indicated in the appended claims and all variations which come within the meaning of the claims are intended to be embraced therein.

We claim:

1. A surface treating method using electric discharge machining for forming a reforming layer on a tooth of a rotating tool, using a surface treating electrode made of a reforming material, comprising:

a first step of placing the surface treating electrode opposite to the tooth; and a second step of relatively moving the surface treating electrode to trace the tooth, while generating an electric discharge between the tooth and the surface treating electrode, thereby forming the reforming layer on the tooth.

2. A surface treating method as defined in claim 1, further comprising:

a third step of detecting relative positions of the surface treating electrode and a cutting edge of the tooth;

a fourth step of correcting the relative positions on the basis of correction information composed of at least one of a peripheral relief angle and a rake angle of the rotating tool as well as a diameter of the surface treating electrode; and a fifth step of fixing the relative positions.

3. A surface treating method as defined in claim 2, wherein:

the surface treating electrode is a body of rotation;

the surface treating electrode is rotated in the second step; and the cutting edge is ground and sharpened by the rotating surface treating electrode in the second step.

4. A surface treating method as defined in claim 1, wherein an angle defined between a discharge surface of the surface treating electrode and a peripheral flank of the tooth is set to enable an eccentric relief sharpening to be made on the peripheral flank in the second step.

5. A surface treating method as defined in claim 4, wherein:

the rotating tool originally has an eccentrically sharpened flank as the peripheral flank; and the reforming layer is formed on the eccentrically sharpened flank.

6. A surface treating method as defined in claim 4, wherein:

the rotating tool originally has a flatly sharpened flank as the peripheral flank;

the electric discharge is generated, in the second step, at a discharge energy to machine a base material of the rotating tool, thereby shaping the flatly sharpened flank into an eccentrically sharpened flank, while forming the reforming layer on the eccentrically sharpened flank.

7. A surface treating method as defined in claim 1, wherein:

an auxiliary member is fitted to the rotating tool, in the second step, so as to be flush with a peripheral flank of the tooth and closely contact with a rake face of the tooth; and the auxiliary member is removed from the rotating tool after the second step.

8. A surface treating method as defined in claim 1, wherein the second step further comprises moving the tooth of the rotating tool relative to the surface treating electrode while maintaining the rotation of the rotating tool and moving the rotating tool in an axial direction according to a relation $(360° \times L \times \tan \Theta)/(\pi \times D)$ between the rotation and the axial movement of the rotating tool, wherein $\Theta$ is a helical angle of the tooth, L is a cutting edge length of the tooth formed with the reforming layer and D is a diameter of the rotating tool.

9. A surface treating apparatus using electric discharge machining, comprising:

a rotating tool having a tooth;

a surface treating electrode made of a reforming material for forming a reforming layer on the tooth;

a relative movement driver for rotating of the tool and relatively moving the surface treating electrode to trace the tooth while placing the surface treating electrode opposite to the tooth; and an electric discharge power source for applying voltage between the tooth and the surface treating electrode.

10. A surface treating apparatus as defined in claim 9, further comprising:

an interpole detecting circuit for detecting an interpole voltage between the rotating tool and the surface treating electrode.

11. A surface treating apparatus as defined in claim 9, further comprising securing means for securing the surface treating electrode at a specific angle as to face the tooth.

12. A surface treating apparatus as defined in claim 9, further comprising mounting means for mounting the surface treating electrode opposite to the tooth, the mounting means being capable of setting and changing a facing angle of the surface treating electrode to the tooth.

13. A surface treating apparatus as defined in claim 9, further comprising rotating means for rotating the surface treating electrode.

14. A surface treating apparatus as defined in claim 9 wherein relative movement driver moves the tooth of the rotating tool relative to the surface treating electrode, while maintaining the rotation of the rotating tool and moving the rotating tool in an axial direction according to a relation $(360° \times L \times \tan \Theta)/(\pi \times D)$ between the rotation and the axial movement of the rotating tool, wherein $\Theta$ is a helical angle of the tooth, L is a cutting edge length of the tooth formed with the reforming layer and D is a diameter of the rotating tool.

* * * * *